US012781422B2

(12) United States Patent
Kim et al.

(10) Patent No.: US 12,781,422 B2
(45) Date of Patent: Nov. 3, 2026

(54) DRYER APPARATUS AND CONTROLLING METHOD THEREOF

(71) Applicant: SAMSUNG ELECTRONICS CO., LTD., Suwon-si (KR)

(72) Inventors: Changwan Kim, Suwon-si (KR); Hoyoung Kim, Suwon-si (KR); Hocheol Lee, Suwon-si (KR); Jongsoo Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 593 days.

(21) Appl. No.: 18/218,765

(22) Filed: Jul. 6, 2023

(65) Prior Publication Data

US 2023/0349090 A1 Nov. 2, 2023

Related U.S. Application Data

(63) Continuation of application No. PCT/KR2021/018922, filed on Dec. 14, 2021.

(30) Foreign Application Priority Data

Jan. 15, 2021 (KR) ..... 10-2021-0006321
Feb. 24, 2021 (KR) ..... 10-2021-0024940

(51) Int. Cl.
*D06F 58/44* (2020.01)
*D06F 34/05* (2020.01)
(Continued)

(52) U.S. Cl.
CPC ..... *D06F 58/38* (2020.02); *D06F 34/05* (2020.02); *D06F 34/14* (2020.02); *D06F 58/08* (2013.01);
(Continued)

(58) Field of Classification Search
CPC ..... H02J 50/001; H02J 50/10; H02J 50/05; D06F 58/48; D06F 58/38; D06F 34/05; D06F 34/06; D06F 34/04; D06F 34/14
(Continued)

(56) References Cited

U.S. PATENT DOCUMENTS 6,983,552 B2 * 1/2006 Park ..... D06F 58/38 34/550
9,951,465 B1 * 4/2018 Herschler ..... D06F 34/05
(Continued)

FOREIGN PATENT DOCUMENTS

CN 107974813 A * 5/2018 ..... D06F 58/46
DE 10 2018 219 349 A1 5/2020
(Continued)

OTHER PUBLICATIONS

English of KR20070015291 by PE2E, Jan. 15, 2026.*
(Continued)

*Primary Examiner* — Deming Wan
(74) *Attorney, Agent, or Firm* — STAAS & HALSEY LLP

(57) ABSTRACT

A dryer which comprises: a communication interface; a drum; a driving motor to drive the drum; a hot wind supplying device to supply hot air to the drum; a sensing device that is self-generating whereby power is generated according to a movement of the sensing device as the drum rotates while the drum is being driven by the driving motor, and transmitting, through the communication interface, a harvester voltage value obtained in association with the sensing device and sensing data sensed by the sensing device; and a processor configured to acquire the sensing data from the sensing device, the sensing data acquired being based on the harvester voltage value which is transmitted from the sensing device while the driving motor is
(Continued)

being controlled based on an input of a user, and control an operation of the hot wind supplying device based on the acquired sensing data.

15 Claims, 28 Drawing Sheets

(51) Int. Cl.

| | |
|---|---|
| ***D06F 34/14*** | (2020.01) |
| ***D06F 58/08*** | (2006.01) |
| ***D06F 58/20*** | (2006.01) |
| ***D06F 58/26*** | (2006.01) |
| ***D06F 58/36*** | (2020.01) |
| ***D06F 58/38*** | (2020.01) |
| ***H02J 50/00*** | (2016.01) |
| ***H02J 50/05*** | (2016.01) |
| ***H02J 50/10*** | (2016.01) |
| *D06F 101/00* | (2020.01) |
| *D06F 103/44* | (2020.01) |
| *D06F 105/30* | (2020.01) |
| *D06F 105/46* | (2020.01) |
| *D06F 105/58* | (2020.01) |

(52) U.S. Cl.
CPC ..... *D06F 58/26* (2013.01); *D06F 2101/00* (2020.02); *D06F 2103/44* (2020.02); *D06F 2105/30* (2020.02); *D06F 2105/46* (2020.02); *D06F 2105/58* (2020.02)

(58) Field of Classification Search
USPC ..... 34/321, 445
See application file for complete search history.

(56) References Cited

U.S. PATENT DOCUMENTS

| | | | | |
|---|---|---|---|---|
| 10,604,887 | B2 | 3/2020 | Kim et al. | |
| 11,643,768 | B2 * | 5/2023 | Han | D06F 58/38 34/528 |
| 2017/0037563 | A1 | 2/2017 | Kulkarni | |
| 2020/0032449 | A1 | 1/2020 | Scheckelhoff et al. | |
| 2020/0374604 | A1 | 11/2020 | Park et al. | |
| 2020/0407903 | A1 | 12/2020 | Han et al. | |

FOREIGN PATENT DOCUMENTS

| | | | | |
|---|---|---|---|---|
| EP | 1 895 043 | B1 | 6/2009 | |
| EP | 1 997 951 | B1 | 3/2011 | |
| JP | 2014-30470 | | 2/2014 | |
| JP | 2018-143646 | | 9/2018 | |
| KR | 20070015291 | A * | 2/2007 | D06F 58/50 |
| KR | 10-2018-0081414 | | 7/2018 | |
| KR | 10-1939089 | | 1/2019 | |
| KR | 10-2020-0135122 | | 12/2020 | |
| KR | 10-2021-0000449 | | 1/2021 | |
| KR | 10-2022-0000276 | | 1/2022 | |
| KR | 10-2022-0032963 | | 3/2022 | |
| KR | 10-2022-0076940 | | 6/2022 | |

OTHER PUBLICATIONS

English of CN107974813 by PE2E, Jan. 15, 2025.*
International Search Report Apr. 6, 2022 in International Patent Application No. PCT/KR2021/018922.
PCT/ISA/237 dated April 6, 2022 in International Patent Application No. PCT/KR2021/018922.
Korean Office Action issued October 20, 2025 for Application No. 10-2021-0024940.

* cited by examiner

DRYER APPARATUS AND CONTROLLING METHOD THEREOF

CROSS-REFERENCE TO RELATED APPLICATION(S)

This application is a continuation application, under 35 U.S.C. § 111(a), of international application No. PCT/KR2021/018922, filed on Dec. 14, 2021, which claims priority under 35 U. S. C. § 119 to Korean Patent Application No. 10-2021-0006321, filed on Jan. 15, 2021 and Korean Patent Application No. 10-2021-0024940, filed on Feb. 24, 2021, the disclosures of which are incorporated herein by reference in their entireties.

BACKGROUND

Field

The disclosure relates to a dry apparatus (dryer) and a controlling method thereof and, more specifically, to a dry apparatus for registering a sensing device used to control a dry process of a dry apparatus, and a controlling method thereof.

Description of the Related Art

A dry apparatus for processing laundry or a washing machine may control the dry process based on sensing data. For example, a suitable process may be determined based on temperature data or humidity data. In addition, the detailed setting of the dry process determined by the user may be automatically changed based on the temperature data or the humidity data.

A dry apparatus or a washing machine may receive sensing data from a separate wireless sensing device rather than a sensing device connected to the washing machine by wire. In addition, the dry apparatus or the washing machine may control the dry process based on the received sensing data.

Here, there is a problem that when a plurality of devices are identified when a dry apparatus or a washing machine attempts to search for a sensing device, it is difficult to determine which device is a suitable device. A process of directly inputting a model name in a situation requiring a process of directly registering a sensing device once at the first time may cause inconvenience to a user.

In addition, when a process of searching for a sensing device is performed at every operation time, a delay occurs, and thus user convenience may be reduced.

SUMMARY

A dryer according to one or more embodiments include a communication interface; a drum to receive a subject to be dried; a driving motor to drive the drum; a hot wind supplying device to supply hot air to the drum; a sensing device that is self-generating whereby power is generated according to a movement of the sensing device as the drum rotates while being driven by the driving motor, the sensing device being enabled to transmit, through the communication interface, a harvester voltage value obtained in association with the sensing device and sensing data sensed by the sensing device; and a processor configured to acquire the sensing data from the sensing device based on the harvester voltage value which is transmitted from the sensing device while the driving motor is being controlled based on a user input, and control an operation of the hot wind supplying device based on the acquired sensing data.

The processor may acquire the sensing data from the sensing device based on a plurality of harvester voltage values received while the driving motor is being controlled.

The harvester voltage value may be a first harvester voltage value received at a first time point at which the drum rotates, and the processor may, based on the first harvester voltage value received at the first time point at which the drum rotates being less than a second harvester voltage value received at a second time point at which a predetermined time has elapsed, acquire the sensing data from the sensing device.

The processor may, based on the harvester voltage value being received at a time point at which the drum stops rotating and being equal to or greater than another harvester voltage value received at another time point at which a predetermined time has elapsed, acquire the sensing data from the sensing device.

The processor may, based on the user input being to register the sensing device in association with the dryer, control the driving motor so that the drum rotates or stops for a predetermined time.

The sensing device may be among a plurality of sensing devices, and the processor may acquire a respective harvester voltage value from each of a plurality of sensing devices while the driving motor is being controlled based on the user input, determine whether at least one sensing device, among the plurality of sensing devices, is identifiable in association with the dryer based on the acquired respective harvester voltage value, and acquire the sensing data from at least one identified sensing device.

The processor may, based on the at least one sensing device being unidentified, output guide information providing guidance to position the sensing device inside the dryer.

The processor may, based on a number of the at least one sensing device exceeding a predetermined number, acquire a number of control operations to rotate and stop the driving motor, and based on the number of control operations being greater than or equal to a threshold value, output guide information providing notification that the sensing device cannot be specified.

The processor may, based on a number of the at least one sensing device exceeding a predetermined number, output guide information to the user to check a number of sensing devices associated with the dryer.

The processor may identify at least one sensing device corresponding to the dryer from among the plurality of sensing devices based on a change amount of the harvester voltage value and a threshold value, and based on the number of the at least one sensing device exceeding a predetermined number, identify at least one sensing device as being associated with the dryer by changing the threshold value.

A method of controlling a dryer comprising communicating with a sensing device that is self-generating whereby power is generated according to a movement of the sensing device as a drum, which is to receive a subject to be dried, rotates while being driven by a driving motor; the sensing device being enabled to transmit a harvester voltage value obtained in association with the sensing device and sensing data sensed by the sensing device. The method includes acquiring the sensing data from the sensing device based on the harvester voltage value which is transmitted from the sensing device while the driving motor is being controlled based on a user input; and controlling an operation of the hot wind supplying device that supplies hot air to the drum based on the acquired sensing data.

The acquiring the sensing data may include acquiring the sensing data from the sensing device based on a plurality of harvester voltage values received while the driving motor is being controlled.

The harvester voltage value may be a first harvester voltage value received at a first time point at which the drum rotates, and the acquiring the sensing data may include, based on the first harvester voltage value received at the first time point at which the drum rotates being less than a second harvester voltage value received at a second time point at which a predetermined time has elapsed, acquiring the sensing data from the sensing device.

The acquiring the sensing data may include, based on the third harvester voltage value being received at a third time point at which the drum stops rotating and being equal to or greater than another harvester voltage value received at another time point at which a predetermined time has elapsed, acquiring the sensing data from the sensing device.

The method may further include, based on a user input to register the sensing device in association with the dryer, controlling the driving motor so that the drum rotates or stops for a predetermined time.

The method may further include acquiring a respective harvester voltage value from each of a plurality of sensing devices while the driving motor is being controlled based on input of the user; and determining whether at least one sensing device, among the plurality of sensing devices, is identifiable in association with the dryer based on the acquired respective harvester voltage value, and the acquiring the sensing data may include acquiring the sensing data from at least one identified sensing device.

The method may further include, based on the at least one sensing device being unidentified, outputting guide information providing guidance to position the sensing device inside the dryer.

The method may further include, based on a number of the at least one sensing device exceeding a predetermined number, acquiring a number of control operations to rotate and to stop the driving motor; and based on the number of control operations being greater than or equal to a threshold value, outputting guide information providing notification that the sensing device cannot be specified.

The method may further include, based on the number of the at least one sensing device exceeding a predetermined number, outputting guide information to the user to check a number of sensing devices associated with the dryer.

The method may further include identifying at least one sensing device associated with the dryer from among the plurality of sensing devices based on a change amount of the harvester voltage value change and a threshold value; and based on a number of the at least one sensing device exceeding a predetermined number, identifying at least one sensing device as being associated with the dryer by changing the threshold value.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
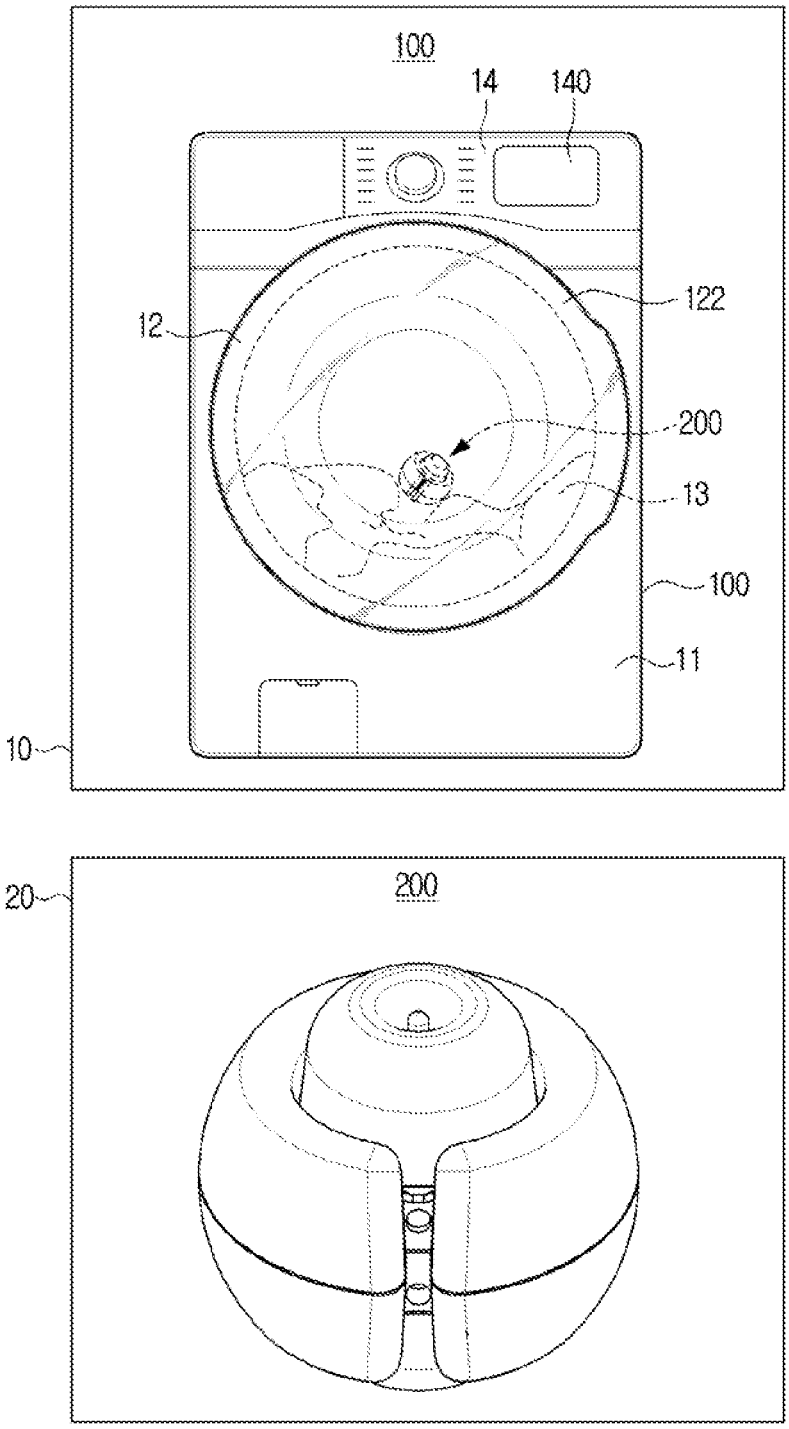
FIG. 1 is a diagram illustrating a sensing device according to one or more embodiments of the disclosure.

Hereinafter, the disclosure will be described in detail with reference to the accompanying drawings.

As terms used in the embodiments of the disclosure, general terms that are currently used widely were selected as far as possible, in consideration of the functions described in the disclosure. However, the terms may vary depending on the intention of those skilled in the art who work in the pertinent technical field or previous court decisions, emergence of new technologies, etc. Also, in particular cases, there may be terms that were arbitrarily designated by the applicant, and in such cases, the meaning of the terms will be described in detail in the relevant descriptions in the disclosure. Accordingly, the terms used in the disclosure should be defined based on the meaning of the terms and the overall content of the disclosure, but not just based on the names of the terms.

Also, in this specification, expressions such as "have," "may have," "include," and "may include" denote the existence of such characteristics (e.g.: elements such as numbers, functions, operations, and components), and do not exclude the existence of additional characteristics.

In addition, the expression "at least one of A and/or B" should be interpreted to mean any one of "A" or "B" or "A and B."

Further, the expressions "first," "second" and the like used in this specification may be used to describe various elements regardless of any order and/or degree of importance. Also, such expressions are used only to distinguish one element from another element, and are not intended to limit the elements.

Also, the description in the disclosure that one element (e.g.: a first element) is "(operatively or communicatively) coupled with/to" or "connected to" another element (e.g.: a second element) should be interpreted to include both the case where the one element is directly coupled to the another element, and the case where the one element is coupled to the another element through still another element (e.g.: a third element).

Meanwhile, singular expressions include plural expressions, as long as they do not obviously mean differently in the context. In addition, in the disclosure, terms such as "include" and "consist of" should be construed as designating that there are such characteristics, numbers, steps, operations, elements, components, or a combination thereof described in the specification, but not as excluding in advance the existence or possibility of adding one or more of other characteristics, numbers, steps, operations, elements, components, or a combination thereof.

Further, in the disclosure, "a module" or "a part" performs at least one function or operation, and may be implemented as hardware or software, or as a combination of hardware and software. Also, a plurality of "modules" or "parts" may be integrated into at least one module and implemented as at least one processor (not shown), except "modules" or "parts" which need to be implemented as specific hardware.

Also, in this specification, the term "user" may refer to a person who uses an electronic apparatus or an apparatus using an electronic apparatus (e.g.: an artificial intelligence electronic apparatus).

The purpose of the disclosure is to provide a dry apparatus for specifying and registering a sensing device corresponding to a dry apparatus based on a harvester voltage received from a sensing device, and a controlling method thereof.

Hereinafter, an embodiment of the disclosure will be described in more detail with reference to the accompanying drawings.

FIG. 1 is a diagram illustrating a sensing device according to one or more embodiments of the disclosure.

Referring to FIG. 1, a dry (drying) apparatus 100 may include a cabinet 11, a door 12, a drum 122, a manipulation panel 14, and a display 140.

Referring to a drawing 10 illustrating the dry apparatus 100, the dry apparatus 100 may be an apparatus that dries a subject to be dried (or laundry or wet laundry or target object for drying) 13 for which washing was completed. The subject to be dried 13 may be clothing, bedding, a towel, etc., but is not limited thereto. Here, the subject to be dried 13 may also be expressed as a subject to be dried.

The dry apparatus 100 may include an air circulating device (not shown) that circulates the air of the drum 122, and a hot wind supplying device (not shown) that heats air of a middle temperature and high humidity discharged from the drum 122 and makes it air of a high temperature and low humidity. For example, the subject to be dried 13 which is damp as washing was completed may be dried inside the drum 122 of the dry apparatus 100 according to the operations of the air circulating device and the hot wind supplying device.

For effectively drying a subject to be dried, the drum 122 may be formed to continuously rotate such that air of a high temperature and low humidity may homogeneously contact the subject to be dried.

On the front surface of the cabinet 11, an inlet through which the subject to be dried 13 may be taken in or taken out may be provided. The door 12 may be hinge-coupled to the front surface of the cabinet 11, and open or close the inlet of the cabinet 11.

In the upper part of the front surface of the cabinet 11, a manipulation panel 14 that can control the dry apparatus 100 may be provided. The manipulation panel 14 may include a display 140 that can display the state of the dry apparatus 100. A user may operate the dry apparatus 100 by manipulating the manipulation panel 14. Here, the manipulation panel 14 may correspond to a user interface (or Manipulation interface) 105. Here, the manipulation panel 14 may be implemented as a circular dial, or implemented as a touch panel.

The drum 122 may be installed to be rotatable inside the cabinet 11, and one end of the drum 122 may be installed to be in communication with the inlet of the cabinet 11.

A sensing device 200 according to one or more embodiments of the disclosure may be introduced into the inside of the drum 122 through the inlet of the dry apparatus 100.

Referring to a drawing 20 illustrating the sensing device 200, the sensing device 200 may be a device that is introduced into the inside of the dry apparatus 100 and is movable. Here, the sensing device 200 may include an energy harvester, a sensor part, a communication interface, and a case. Here, the sensing device 200 may also be described as a sensor ball.

The energy harvester is formed to convert a movement of the sensing device 200 into electricity. In other words, the energy harvester may generate power by using a movement of the sensing device 200.

For example, in a state wherein the sensing device 200 is put inside the drum 122 of the dry apparatus 100, if the dry apparatus 100 is operated, the drum 122 rotates. When the drum rotates 122, the sensing device 200 introduced into the inside of the drum 122 performs a free fall movement. That is, according to the rotation of the drum 122, the sensing device 200 falls from the upper part of the inner space of the drum 122 to the lower part. Then, the energy harvester may convert the movement of the sensing device 200, i.e., the free fall movement into electricity. In other words, it may be said that the energy harvester of the sensing device 200 converts a rotating movement of the drum 122 into electricity. For this, the energy harvester may generate power by using a permanent magnet and a coil.

The energy harvester may include a cylinder, a coil, and a permanent magnet. When the sensing device 200 introduced into the drum 122 is moved by the drum 122, the energy harvester may generate power. That is, the energy harvester of the sensing device 200 may convert a rotation of the drum 122 of the dry apparatus 100 into electricity.

The sensor part may include at least one of a movement amount measurement sensor for sensing a movement amount of the sensing device 200, a harvester voltage sensor for sensing a harvester voltage of the energy harvester, a contact-type electrode sensor for sensing the dry degree of the surface contacting the sensing device 200, a temperature sensor, or a humidity sensor.

Here, the harvester voltage sensor may measure a voltage measured based on a movement amount of the sensing device 200. For example, as a movement amount of the sensing device 200 is greater, a harvester voltage may be measured to be higher.

Here, the contact-type voltage sensor may mean an electrode sensor for identifying the dry degree of the surface of the sensing device 200. The contact-type voltage sensor may sense how much humidity a subject to be dried has while contacting the subject to be dried. In case a subject to be dried has a lot of moisture, a voltage acquired from the contact-type voltage sensor may be measured to be low. In case a subject to be dried has no moisture or the contact-type voltage sensor does not contact a subject to be dried, a voltage acquired from the contact-type voltage sensor may be measured to be high.

The sensor part may acquire at least one of a movement amount, a harvester voltage, a moving pattern, a dry degree, a temperature, or humidity of the sensing device 200. Here, the sensor part may include at least one of a distance sensor that can measure a movement amount of the sensing device, a harvester voltage measurement sensor according to a movement, a moving pattern analysis module, a contact-type electrode sensor that can measure a dry degree, a temperature sensor, or a humidity sensor. Depending on implementation examples, the sensor part may perform only measurement of a movement amount, and analysis of a moving pattern may be performed at the dry apparatus 100.

Here, the communication interface may transmit sensing data acquired at the sensor part to the dry apparatus 100. Here, the communication interface may include a wireless communication module, and the wireless communication module may be a communication module using one of Bluetooth, Wi-Fi, Zigbee, or Z-wave.

Here, the case may be a member enclosing the energy harvester, the sensor part, and the communication interface, and it may comprise a member for which waterproofing was performed.

The sensing device 200 described in FIG. 1 may be a mobile sensing device. For example, when the drum 122 is rotated, the sensing device 200 may move in a state in which the drum 122 is not fixed to the drum 122.

In the meantime, according to an implementation example, the sensing device 200 may be a fixed sensing device. For example, when the drum 122 rotates, the sensing device 200 may rotate together while being fixed to the drum 122.

Figure 2:
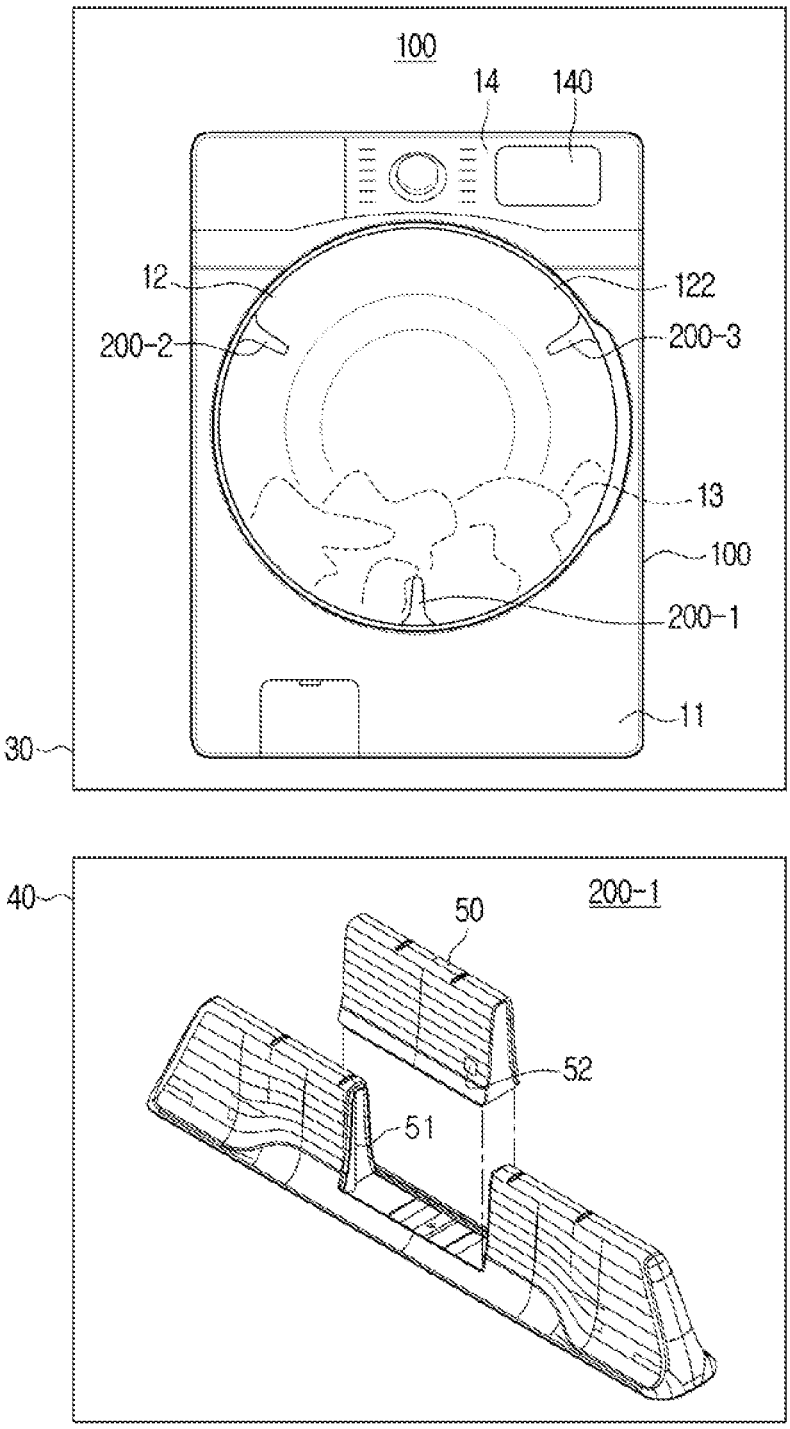
FIG. 2 is a diagram illustrating a sensing device according to another embodiment of the disclosure.

FIG. 2 is a diagram illustrating a sensing device according to another embodiment of the disclosure.

Referring to FIG. 2, the description related to the dry apparatus 100 and the sensing device 200 has been provided in FIG. 1 and a duplicate description will be omitted.

Referring to the drawing 30 showing the dry apparatus 100, the sensing device 200 may be implemented with a plurality of fixed sensing devices 200-1, 200-2, 200-3. Here, the plurality of fixed sensing devices 200-1, 200-2, 200-3 may be arranged on the drum at intervals of 120 degrees. Here, three fixed sensing devices 200-1, 200-2, 200-3 are illustrated, but only one sensing device 200-1 may be arranged in implementation.

Referring to a drawing 40 illustrating the sensing device 200-1, the sensing device 200 may include a sensing block 50 and a mounting part 51.

The sensing block 50 may be detachably coupled to a sensing lifter (not shown) attached to the drum 122. In addition, the sensing block 50 may include an energy harvester (not shown), a sensor unit (not shown), a circuit board (not shown), and an air passage 52. Here, the sensing lifter may include a mounting part 51 to which the sensing block 50 may be attached/detached. Here, a sensor unit included in the sensing block 50 may acquire sensing data acquired by sensing at least one of temperature information or humidity information.

Here, when the sensing block 50 is formed in a separable form, there is an advantage that maintenance of a sensing lifter (not shown) is convenient. For example, when the sensor unit or the circuit board fails, the sensing block 50 may be simply replaced from a sensing lifter fixed to the inner surface of the drum 122.

Figure 3:
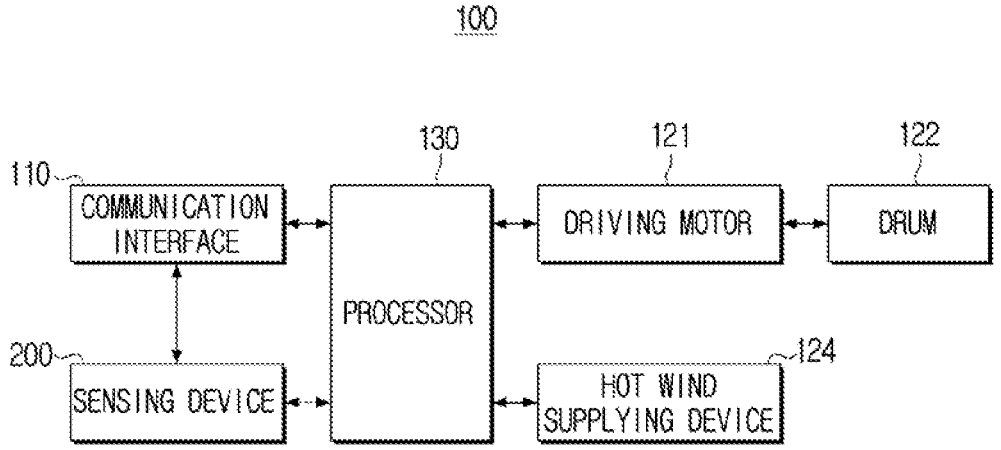
FIG. 3 is a block diagram illustrating a dry apparatus according to one or more embodiments of the disclosure.

FIG. 3 is a block diagram illustrating a dry apparatus according to one or more embodiments of the disclosure.

Referring to FIG. 3, the dry apparatus 100 may include the communication interface 110, the driving motor 121, the drum 122, a hot wind supplying device 124, and a processor 130.

The driving motor 121 may generate driving force by receiving power to rotate the drum 122 or may generate driving force in a reverse direction to stop the drum 122.

The drum 122 may mean a drying container for accommodating an object to be dried. The drum 122 may be rotated by a driving force generated by the driving motor 121.

The hot wind supplying device 120 may provide heat source to the drum 122.

The processor 130 may receive the harvester voltage value and the sensing data from the sensing device 200 through the communication interface 110.

Here, the sensing device 200 may refer to a device which self-generates according to the rotation of the drum 122 and transmits the generated harvester voltage value and sensing data to the communication interface 110.

According to one or more embodiments, the sensing device 200 may be a separate device which is not physically connected to the dry apparatus 100. A description related to the same has been described with reference to FIG. 1. According to another embodiment, the sensing device 200 may be a device included in the dry apparatus 100. A description related to the same has been described with reference to FIG. 2.

The processor 130 may perform an overall control operation of the dry apparatus 100. Specifically, the processor 130 may function to control the overall operation of the dry apparatus 100.

The processor 130 may be implemented with, for example, and without limitation, a digital signal processor (DSP) for processing of a digital signal, a microprocessor, a time controller (TCON), or the like, but the processor is not limited thereto. The processor 130 may include, for example, and without limitation, one or more among a central processor (CPU), a micro controller unit (MCU), a micro processor (MPU), a controller, an application processor (AP), a communication processor (CP), an advanced reduced instruction set computing (RISC) machine (ARM) processor, a dedicated processor, or may be defined as a corresponding term. The processor 130 may be implemented in a system on chip (SoC) type or a large scale integration (LSI) type which a processing algorithm is built therein, application specific integrated circuit (ASIC), or in a field programmable gate array (FPGA) type. In addition, the processor 130 may perform various functions by executing computer executable instructions stored in the memory.

The dry apparatus 100 may acquire sensing data from the sensing device 200 based on a harvester voltage value received from the sensing device 200 while the driving motor 121 is controlled based on a user input; and may control an operation of the hot wind supplying device 124 based on the received sensing data.

The processor 130 may control the dry apparatus 100 to operate in a registration mode based on a user input. Herein, the registration mode may mean a mode for performing an operation of identifying a targeted apparatus (or target device or target apparatus) corresponding to the dry apparatus 100. Herein, the targeted apparatus may refer to a sensing device for transmitting sensing data used for a dry process of the dry apparatus 100. Specifically, the processor 130 may identify (or search or find) a device capable of communicating with the dry apparatus 100 around the dry apparatus 100. In addition, the processor 130 may identify at least one device (targeted apparatus) which is present inside the dry apparatus 100 among a plurality of devices capable of communicating with the dry apparatus 100 and transmits sensing data. Here, the operation of identifying the targeted apparatus may refer to an operation of identifying whether the sensing device 200 is present inside the dry apparatus 100.

Here, it is assumed that the sensing device 200 is recognized around the dry apparatus 100.

Here, the processor 130 may transmit a signal requesting transmission of a harvester voltage value to the sensing device 200. In addition, the sensing device 200 may transmit the harvester voltage value to the dry apparatus 100. In addition, the processor 130 may identify whether the sensing device 200 is a targeted apparatus corresponding to the dry apparatus 100 based on the harvester voltage value received from the sensing device 200.

Here, the processor 130 may perform a test operation to identify the targeted apparatus. The processor 130 may control the dry apparatus 100 to operate in a test mode for performing a test operation. Specifically, the processor 130 may perform at least one operation of rotating the drum 122 by a predetermined time or stopping the drum 122 by a predetermined time. The processor 130 may receive the harvester voltage value from the sensing device 200 while performing the test operation. Here, the processor 130 may control the driving motor 121 to rotate or stop the drum 122.

Here, if the sensing device 200 is present inside the dry apparatus 100, the harvester voltage value may increase or drop according to whether the drum 122 rotates. Therefore, the processor 130 may identify whether the sensing device 200 is a targeted apparatus based on the harvester voltage value received from the sensing device 200. A detailed description related to the same will be described later with reference to FIGS. 9 to 13.

Here, when the sensing device 200 is identified as a targeted apparatus, the processor 130 may receive sensing data from the sensing device 200. The processor 130 may perform a dry process by controlling the operation of the hot wind supplying device 124 based on the received sensing data.

The processor 130 may acquire sensing data from the sensing device 200 through the communication interface 110 based on a plurality of harvester voltage values received while the driving motor 121 is controlled.

The processor 130 may control the driving motor 121 to rotate or stop the drum 122 in order to perform a test operation. The harvester voltage value may be received from the sensing device 200 while the drum 122 is rotated or stopped. Here, the processor 130 may receive a plurality of harvester voltage values from the sensing device 200. For example, the processor 130 may receive a first harvester voltage value at a first time point, receive a second harvester voltage value at a second time point, receive a third harvester voltage value at a third time point, and receive a fourth harvester voltage value at a fourth time point. Here, the first time point means a point in time when the drum 122 starts to rotate, the second time point means a point in time at which a predetermined time has elapsed since the first time point, the third time point means a point in time when the drum 122 rotates and then stops, and the fourth time point means a point in time at which a predetermined time has elapsed after the third time point. A detailed description related to the same will be described later with reference to FIGS. 8 to 13.

Here, the first time point to the fourth time point may be replaced with a first time to a fourth time. Here, the processor 130 may acquire, as a first harvester voltage value to a fourth harvester voltage value, an average value of the harvester voltage value acquired at each of the first time to the fourth time. For example, the processor 130 may acquire an average value of a harvester voltage value acquired from 2 seconds to 4 seconds as a first harvester voltage value, and acquire an average value of the harvester voltage value acquired from ten seconds to 12 seconds as a second harvester voltage value.

Here, the processor 130 may compare the acquired plurality of harvester voltage values to identify whether the sensing device 200 is a targeted apparatus. When the sensing device 200 is identified as a targeted apparatus, the processor 130 may receive sensing data from the sensing device 200.

In the meantime, the processor 130 may acquire sensing data from the sensing device 200 through the communication interface 110 if a first harvester voltage value received at a first time point at which the drum 122 rotates is less than a second harvester voltage value received at a second time point at which a predetermined time has elapsed.

Here, the processor 130 may identify whether the sensing device 200 is a targeted apparatus by comparing a first harvester voltage value received at a first time point and a second harvester voltage value received at a second time point. If the sensing device 200 exists inside the drum 122, the sensing device 200 may also be rotated according to the rotation of the drum 122. Therefore, the sensing device 200 may increase a harvester voltage value while the drum 122 rotates. Therefore, if the first harvester voltage value is less than the second harvester voltage value, the processor 130 may determine that the sensing device 200 is present inside the drum 122. The processor 130 may identify the sensing device 200 as a targeted apparatus. In addition, the processor 130 may receive sensing data from the sensing device 200. A detailed description related to the same will be described later with reference to FIGS. 8 to 10.

In the meantime, the processor 130 may acquire sensing data from the sensing device 200 through the communication interface 110 if a third harvester voltage value received at a third time point at which the drum 122 stops is equal to or greater than a fourth harvester voltage value received at a fourth time point when a predetermined time has elapsed.

Here, the processor 130 may identify whether the sensing device 200 is a targeted apparatus by comparing a third harvester voltage value received at a third time point and a fourth harvester voltage value received at a fourth time point. If the sensing device 200 is present inside the drum 122, the sensing device 200 may be stopped as the rotation of the drum 122 is stopped. Therefore, the sensing device 200 may drop (or maintain) the harvester voltage value while the drum 122 stops. Substantially, since the sensing device 200 has to drive minimal hardware, the harvester voltage value may be dropped. Therefore, when the third harvester voltage value is equal to or greater than the fourth harvester voltage value, the processor 130 may determine that the sensing device 200 is present inside the drum 122. In addition, the processor 130 may identify the sensing device 200 as a targeted apparatus. In addition, the processor 130 may receive sensing data from the sensing device 200. A detailed description related to the same will be described later with reference to FIGS. 11 to 13.

The processor 130 may control the driving motor 121 to rotate or stop the drum 122 for a predetermined time based on a user input for registering the sensing device 200 corresponding to the dry apparatus 100.

Here, the processor 130 may receive a user input through a manipulation interface 105. Herein, the user input may be an input for registering the sensing device 200. The processor 130 may receive a user input for registering the sensing device 200 as a targeted apparatus of the dry apparatus 100. The processor 130 may perform a test operation based on a user input. The test operation may include at least one of an operation of controlling the driving motor 121 to rotate the drum 122 for a predetermined time or an operation of stopping the drum for a predetermined time. According to one or more embodiments, the test operation may be an operation of rotating the drum 122 for ten seconds. According to another embodiment, the test operation may be an operation of rotating the drum 122 for ten seconds. According to another embodiment, the test operation may be an operation of rotating the drum 122 for ten seconds and then stopping the drum 122 for ten seconds.

The processor 130 may acquire a harvester voltage value from each of a plurality of sensing devices 201, 202 while the driving motor 121 is controlled based on the user input; and identify at least one sensing device corresponding to the dry apparatus 100 among the plurality of sensing devices 201, 202 based on the acquired harvester voltage value, and may acquire the sensing data from at least one identified sensing device through the communication interface 110.

The processor 130 may identify a device capable of communicating with the dry apparatus 100 based on a user command for starting a registration mode. For example, the processor 130 may search for devices located around the dry apparatus 100 and capable of short-range wireless communication. It is assumed that the searched device is two. The processor 130 may receive a harvester voltage value from each of the two devices through the communication interface 110. In addition, the processor 130 may compare the received harvester voltage values to identify whether each of the two devices is a targeted apparatus. If it is assumed that the targeted apparatus is one, the processor 130 may determine one of the two devices as a targeted apparatus. If it is assumed that the targeted apparatus is two, the processor 130 may determine that all of the two devices are targeted apparatus.

Here, the sensing device corresponding to the dry apparatus 100 may mean a targeted apparatus. A device capable of communication connection may not be a sensing device used in the dry apparatus 100. Therefore, the processor 130 may perform an operation of identifying a targeted apparatus among the plurality of devices.

Here, the processor 130 may receive sensing data from a device determined as a targeted apparatus. A specific operation in connection with an embodiment of receiving a harvester voltage value from a plurality of sensing devices will be described later with reference to FIGS. 14, 15, and 22 to 26.

In the meantime, the processor 130 may, based on the at least one sensing device not being identified, output first guide information for guiding the sensing device 200 to be positioned inside the dry apparatus 100.

Here, if a device capable of communication connection is not identified at all or there is no device identified as a targeted apparatus among devices capable of communication connection, the processor 130 may output first guide information. Here, the first guide information may refer to information for guiding the targeted apparatus to be positioned inside the drum 122 so that a targeted apparatus corresponding to the dry apparatus 100 may be recognized. For example, the first guide information may be guide information 1710 of FIG. 17.

In the meantime, if the number of at least one sensing device exceeds a predetermined number, the processor 130 may acquire the number of control operations for rotating and stopping the driving motor 121, and when the number of control operations is greater than or equal to a threshold value, may output second guide information for notifying that the sensing device cannot be specified.

Here, the number of targeted apparatus to be used in the dry apparatus 100 may be predetermined. It is assumed that the number of targeted apparatus is one. When the number of targeted apparatus is identified as two, the processor 130 may determine that the targeted apparatus is not explicitly specified. Therefore, the processor 130 may analyze the harvester voltage value by rotating or stopping the drum 122 until the number of targeted apparatus becomes a predetermined number.

Here, the processor 130 may identify the number of cycles for rotating or stopping the drum 122, and when the number of cycles is greater than or equal to a threshold value, determine that the registration of the targeted apparatus has failed. For example, even though the operation of rotating and stopping the drum 122 is performed three times or more, if it is identified that the targeted apparatus is two, the processor 130 may determine that a registration mode for specifying the targeted apparatus has failed. When it is determined that the registration mode has failed, the processor 130 may output second guide information.

Here, the second guide information may include information that a greater number of devices than the predetermined number is identified and a particular the targeted apparatus may not be specified. For example, the second guide information may be guide information 1810 of FIG. 18.

If the number of at least one sensing device exceeds a predetermined number, the processor 130 may output third guide information for confirming the number of sensing devices corresponding to the dry apparatus 100 to the user.

Here, the third guide information may include information indicating that the targeted apparatus has been identified by a number greater than the predetermined number and information for querying the user whether to set a greater number of devices to the targeted apparatus than the predetermined number.

Here, if a command indicating that a number of devices greater than a predetermined number by a user will be registered as a targeted apparatus, the processor 130 may register all of the currently identified targeted apparatus. For example, the third guide information may be guide information 1910 of FIG. 19.

According to one or more embodiments, the predetermined number may be 1, and when two or more targeted apparatuses are identified, the processor 130 may output third guide information to request an additional response of a user.

The operation of outputting guide information in the above description includes at least one of an operation of outputting guide information as image data through the display 140 or an operation of outputting guide information as audio data through the speaker 160.

In the meantime, the processor 130 may identify at least one sensing device corresponding to the dry apparatus 100 among the plurality of sensing devices based on the acquired harvester voltage value change amount and threshold value, and may identify at least one sensing device corresponding to the dry apparatus 100 by changing the threshold value when the number of the at least one sensing device exceeds a predetermined number.

Here, the processor 130 may receive a first harvester voltage value at a first time point and a second harvester voltage value at a second time point from the sensing device 200 while the drum 122 is rotating. Here, the processor 130 may acquire a harvester voltage value change amount (or a value acquired in a rotation state of the drum 122, a value acquired by subtracting the first harvester voltage value from the second harvester voltage value) based on a difference value between the first harvester voltage value and the second harvester voltage value. When the amount of change in the harvester voltage value is greater than or equal to a first threshold value, the processor 130 may identify that the sensing device 200 is a targeted apparatus.

Also, the processor 130 may receive a third harvester voltage value at a third time point and a fourth harvester voltage value at a fourth time point from the sensing device 200 while the drum 122 is stopped. Here, the processor 130 may acquire a harvester voltage value change amount (or a harvester voltage value change amount acquired in a stopped state of the drum 122, a value acquired by subtracting a fourth harvester voltage value from a third harvester voltage value) based on a difference value between a third harvester voltage value and a fourth harvester voltage value. When the amount of change in the harvester voltage value is greater than or equal to a third threshold value, the processor 130 may identify that the sensing device 200 is a targeted apparatus.

Here, the processor 130 may identify the targeted apparatus based on at least one of a first threshold value or a third threshold value while performing an initial test operation. However, in an initial test operation, the targeted apparatus may be identified more than a predetermined number. Here, the processor 130 may need to re-specify the number of targeted apparatuses. For example, if five targeted apparatuses have to be identified, the processor 130 may repeat the test operation until one targeted apparatus becomes one.

Here, if the targeted apparatus exceeds a predetermined number, the processor 130 may change a criterion used to identify the targeted apparatus. Specifically, the processor 130 may identify the targeted apparatus by changing at least one of a first threshold value or a third threshold value. Specifically, the processor 130 may change the first threshold value to a second threshold value greater than the first threshold value or change the third threshold value to a fourth threshold value greater than the third threshold value. The processor 130 may identify the targeted apparatus based on at least one of a third threshold value or a fourth threshold value.

Here, when the threshold value is changed, the number of devices identified as the targeted apparatus may be reduced as a criterion for identifying the targeted apparatus is complicated. A detailed description related to the same will be described later with reference to FIG. 21.

In the meantime, the dry apparatus 100 according to various embodiments of the disclosure may identify a targeted apparatus corresponding to the dry apparatus 100 among a plurality of apparatuses. Therefore, convenience may be improved in that a user may automatically specify a desired sensing device.

In addition, the sensing device 200 may accurately determine whether the sensing device 200 is a targeted apparatus through an operation of comparing the harvester voltage value in a process of identifying the targeted apparatus.

Also, when it is determined that a targeted apparatus is difficult to be specified despite repeated test operations, various kinds of guide information may be outputted, thereby providing information to a user and improving user convenience.

Various embodiments of the disclosure are described as being an operation of the dry apparatus 100. However, according to one or more embodiments, an operation may be performed in the washing machine 300 instead of the dry apparatus 100. The sensing device 200 may be used in the washing machine 300 as well as the dry apparatus 100. In addition, the sensing device 200 may be applied to various other electronic devices.

A simple configuration of FIG. 3 has been illustrated and described, but various configurations may be further provided in implementation. This will be described below with reference to FIG. 4.

Figure 4:
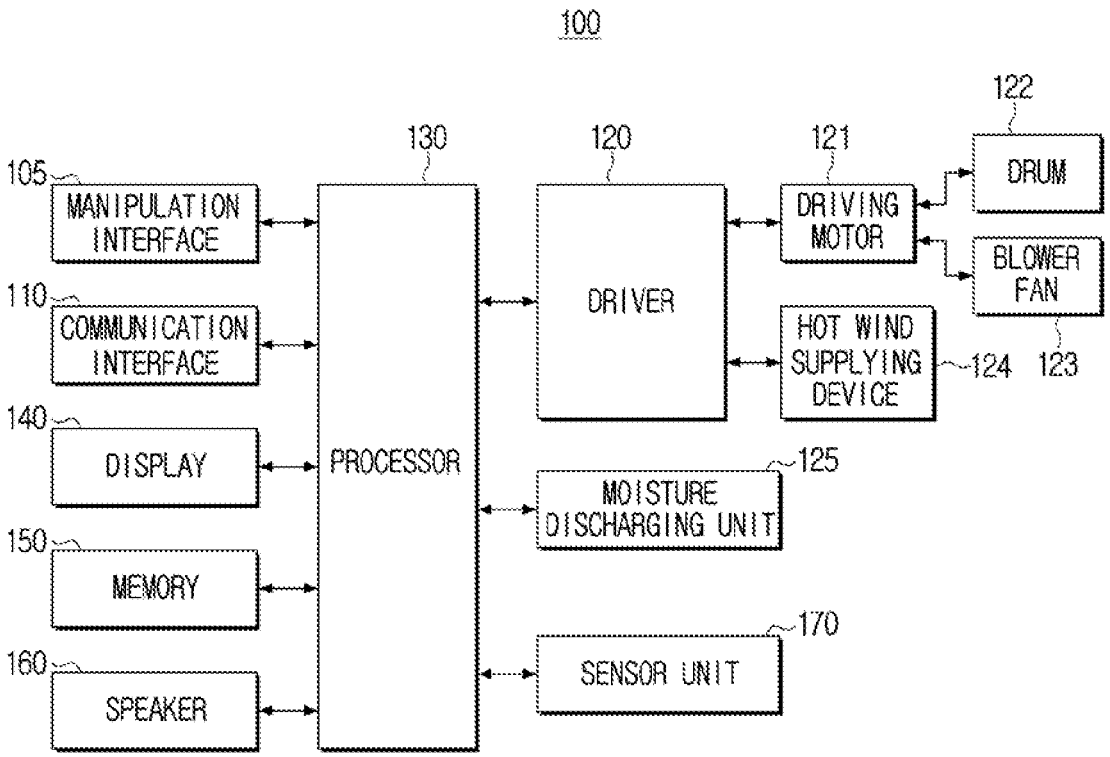
FIG. 4 is a block diagram illustrating a detailed configuration of the dry apparatus of FIG. 3 according to an embodiment of the present disclosure.

FIG. 4 is a block diagram illustrating a detailed configuration of the dry apparatus of FIG. 3.

Referring to FIG. 4, the dry apparatus 100 may include a manipulation interface 105, a communication interface 110, a driver 120, a driving motor 121, a drum 122, a blower fan 123, a hot wind supplying device 124, a moisture discharging unit 125, a processor 130, a display 140, a memory 150, a speaker 160, and a sensor unit 170.

The same operation as described above among the operations of the communication interface 110, the driving motor 121, the drum 122, the hot wind supplying device 124, and the processor 130 will be omitted.

The driver 120 may drive the driving motor 121 based on a driving control signal generated by the processor 130.

The driving motor 121 may receive power and generate a driving force, and the driving motor 121 may transmit the generated driving force to the drum 122 and the blowing fan 123.

The drum 122 may mean a dry tub accommodating the subject to be dried. The drum 122 may be rotated by the driving force generated from the driving motor 121.

The blowing fan 123 may mean a fan that circulates air of a high temperature supplied to the drum of the dry apparatus 100. Specifically, the blowing fan 123 may receive a driving control signal generated by the processor 130, and rotate to circulate the air inside the drum to which a heat source was supplied.

The driving part 120 may receive the driving control signal generated by the processor 130, and drive the hot wind supplying device 124 such that it can supply a heat source to the drum.

The hot wind supplying device 124 may be implemented by a gas type heat source supplying method or an electricity type heat source supplying method. The gas type method may mean a method of heating air by using gas. The electricity type method may mean a method of heating air by using electricity. The electricity type method may be a method of using at least one of a hot wind supplying device or a heat pump. The hot wind supplying device may use a method of supplying a heat source by using a heat wire, etc. The heat pump may use a method of supplying a heat source by using a refrigerant. The heat pump may consist of an evaporator, a compressor, and a condenser. Specifically, the evaporator may evaporate a refrigerant in a liquid state to a gaseous state. Then, the refrigerant in a gaseous state may be transmitted to the compressor. The compressor may compress the refrigerant in a state of a high temperature and high pressure. Then, the compressed refrigerant may be transmitted to the condenser. The condenser may perform a heat-exchanging operation from the compressed refrigerant and take heat, and heat the air with the taken heat and discharge the air. Here, the discharged air of a hot temperature may be supplied to the drum 122 of the dry apparatus 100. The refrigerant from which heat was taken by the condenser may be transmitted to the evaporator and circulated.

The moisture discharging unit 125 may discharge moisture inside the dry apparatus 100. The dry apparatus 100 may be a vent type (a hot wind discharging method) or a condensing type (a hot wind dehumidifying method) according to the method of discharging moisture. The vent type method may be a method of discharging moisture and dust to the outside of the dry apparatus 100. The condensing type method may be a method of filtering dust through a filter and making moisture pass through a condenser (a heat exchanger), and converting the moisture into condensed water. The condensed water may be discharged to the outside of the dry apparatus 100 or stored in an inner tub of the dry apparatus 100.

The display 140 may be implemented as displays in various forms such as a liquid crystal display (LCD), an organic light emitting diodes (OLED) display, a plasma display panel (PDP), etc. Inside the display 140, driving circuits that may be implemented in forms such as an a-si TFT, a low temperature poly silicon (LTPS) TFT, an organic TFT (OTFT), etc., a backlight unit, etc. may also be included. Meanwhile, the display 140 may be implemented as a touch screen combined with a touch sensor, a flexible display, a three-dimensional display (a 3D display), etc.

Also, the display 140 according to one or more embodiments of the disclosure may include not only a display panel outputting images, but also a bezel housing the display panel. In particular, the bezel according to one or more embodiments of the disclosure may include a touch sensor (not shown) for detecting user interactions.

The memory 150 may be implemented as an internal memory such as a ROM (e.g., an electrically erasable programmable read-only memory (EEPROM)), a RAM, etc. included in the processor 130, or implemented as a separate memory from the processor 130. In this case, the memory 150 may be implemented in a form of a memory embedded in the dry apparatus 100, or in a form of a memory that may be attached to or detached form the dry apparatus 100 according to the use of stored data. For example, in the case of data for an operation of the dry apparatus 100, the data may be stored in a memory embedded in the dry apparatus 100, and in the case of data for an extended function of the dry apparatus 100, it may be stored in a memory that may be attached to or detached from the dry apparatus 100.

Meanwhile, in the case of a memory embedded in the dry apparatus 100, it may be implemented as at least one of a volatile memory (e.g.: a dynamic RAM (DRAM), a static RAM (SRAM), or a synchronous dynamic RAM (SDRAM), etc.) or a non-volatile memory (e.g.: a one time programmable ROM (OTPROM), a programmable ROM (PROM), an erasable and programmable ROM (EPROM), an electrically erasable and programmable ROM (EEPROM), a mask ROM, a flash ROM, a flash memory (e.g.: a NAND flash or a NOR flash, etc.), a hard drive, or a solid state drive (SSD)). Meanwhile, in the case of a memory that may be attached to or detached from the dry apparatus 100, it may be implemented as forms such as a memory card (e.g., a compact flash (CF), a secure digital (SD), a micro secure digital (Micro-SD), a mini secure digital (Mini-SD), an extreme digital (xD), a multi-media card (MMC), etc.), an external memory that may be connected to a USB port (e.g., a USB memory), and the like.

The speaker 160 may be a component that outputs not only various kinds of audio data processed at an input/output interface, but also various kinds of notification sounds or voice messages, etc.

The sensor unit 170 may include at least one of a temperature sensor, a humidity sensor, or an image sensor.

Here, the temperature sensor may sense the temperature inside the dry apparatus 100. The temperature sensor may include at least one of a first temperature sensor for sensing the air temperature of the drum 122 inside the dry apparatus 100 or a second temperature sensor for sensing the temperature of the refrigerant inside the dry apparatus 100. The temperature data sensed by the temperature sensor may be transmitted to the processor 130, and the processor 130 may control an operation of the dry apparatus 100 based on the sensed temperature data.

Here, the humidity sensor may generate humidity data by sensing humidity inside the dry apparatus 100.

Here, the image sensor may refer to a camera and may generate image data by capturing an image of a subject. The image sensor may capture the inside or outside of the dry apparatus 100.

Figure 5:
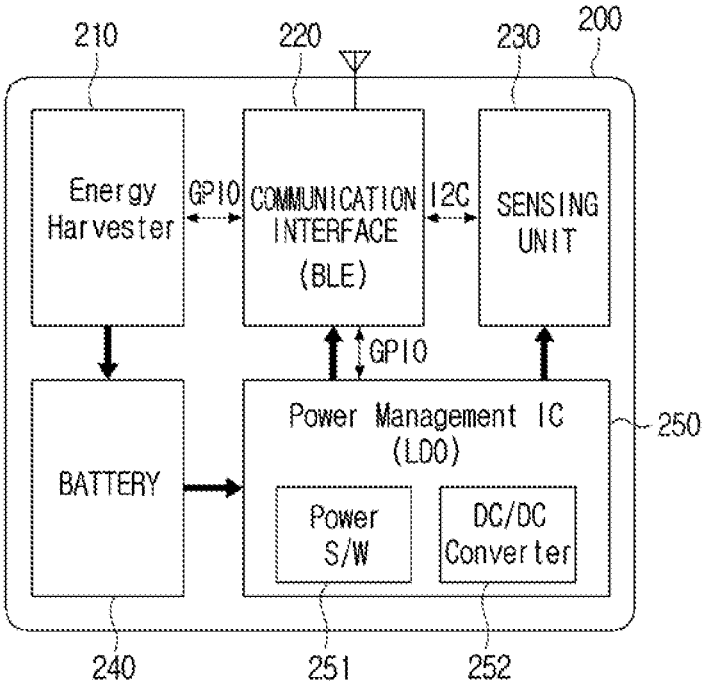
FIG. 5 is a block diagram illustrating a configuration of a sensing device according to an embodiment of the present disclosure.

FIG. 5 is a block diagram illustrating a configuration of a sensing device.

Referring to FIG. 5, the sensing device 200 may include at least one of an energy harvester 210, a communication interface 220, a sensing unit 230, a battery 240, and a power management module 250.

Here, the energy harvester 210 may acquire energy generated according to the rotation of the drum 122 of the dry apparatus 100. Here, the acquired energy may be stored in the battery 240.

Here, the communication interface 220 may perform infrared, Wi-Fi, and Bluetooth communication. The Bluetooth communication may refer to Bluetooth Low Energy (BLE) communication. The communication interface 220 may exchange information with the energy harvester 210 or the power management module 250 in a general-purpose input/output (GPIO) scheme. In addition, the communication interface 220 may exchange information with the sensing unit 230 in an inter-integrated circuit (I2C) method. Meanwhile, the communication interface 220 may be implemented in the form of being included in a micro controller unit (MCU) or a microcomputer.

The sensing unit 230 may include at least one of a temperature sensing module, a humidity sensing module, or an acceleration sensing module.

Here, the battery 240 may be composed of a capacitor. In addition, the battery 240 may store or charge the voltage collected by the energy harvester 210. Here, the voltage stored or charged in the battery 240 may be supplied to various hardware configurations of the sensing device 200 through the power management module 250.

The power management module 250 may include a power software 251 and a DC-DC converter 252. The power software 251 may control an operation of supplying power to each of various hardware included in the sensing device 200. The DC-DC converter 252 may change the magnitude of the DC voltage to be high or low.

Figure 6:
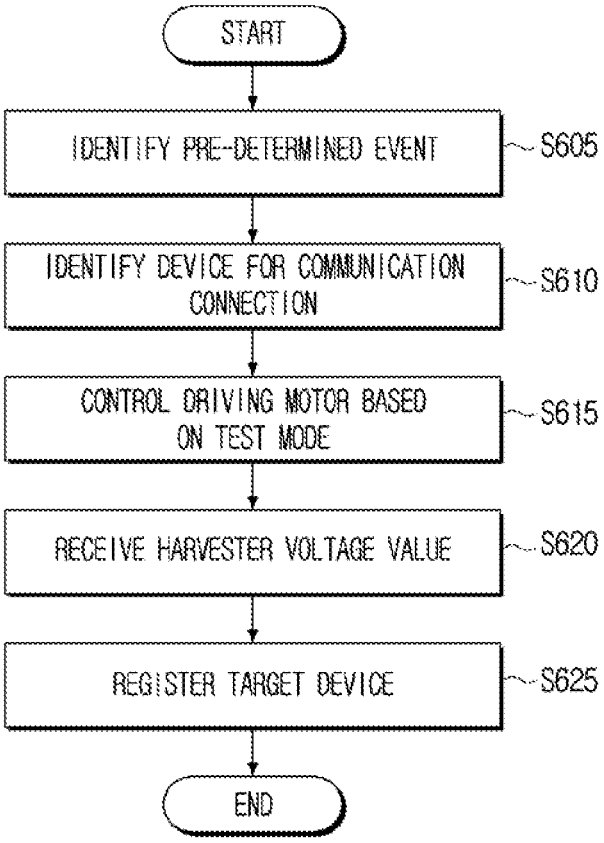
FIG. 6 is a flowchart illustrating an operation of registering a sensing device through a test mode according to an embodiment of the present disclosure.

FIG. 6 is a flowchart illustrating an operation of registering a sensing device through a test mode.

Referring to FIG. 6, the dry apparatus 100 may identify a predetermined event in operation S605. Here, the predetermined event may be an event for receiving a user input for registering a targeted apparatus corresponding to the dry apparatus 100. Here, the user input may be received through the communication interface 110 or acquired through the manipulation interface 105.

In addition, the dry apparatus 100 may identify a communication-connectable device in operation S610. Here, the dry apparatus 100 may search for a targeted apparatus for acquiring sensing data used for a dry process. Here, the targeted apparatus may mean the sensing device 200 corresponding to the dry apparatus 100. Here, the dry apparatus 100 may search for a device capable of communicating with the dry apparatus 100 through a broadcasting method.

In addition, the dry apparatus 100 may control the driving motor 121 in a test mode in operation S615. Here, the dry apparatus 100 may control the driving motor 121 to rotate the drum 122. Specifically, the dry apparatus 100 may perform a test operation by rotating the drum 122 for a predetermined time or stopping the drum 122 for a predetermined time.

In operation S620, the dry apparatus 100 may receive the harvester voltage value from the device identified (or searched) through the operation S610. Here, the dry apparatus 100 may identify whether the corresponding device is a targeted apparatus based on the harvester voltage value received while performing the test operation. Here, when a harvester voltage value is not received from the identified (or searched) device, the dry apparatus 100 may release a communication connection with the corresponding device or determine that the corresponding device is not the targeted apparatus.

In addition, the dry apparatus 100 may register the device identified as the targeted apparatus in operation S625. Specifically, the dry apparatus 100 may store identification information of the device identified as a targeted apparatus in the memory 150. The dry apparatus 100 may receive sensing data from a device corresponding to the identification information stored in the memory 150.

Figure 7:
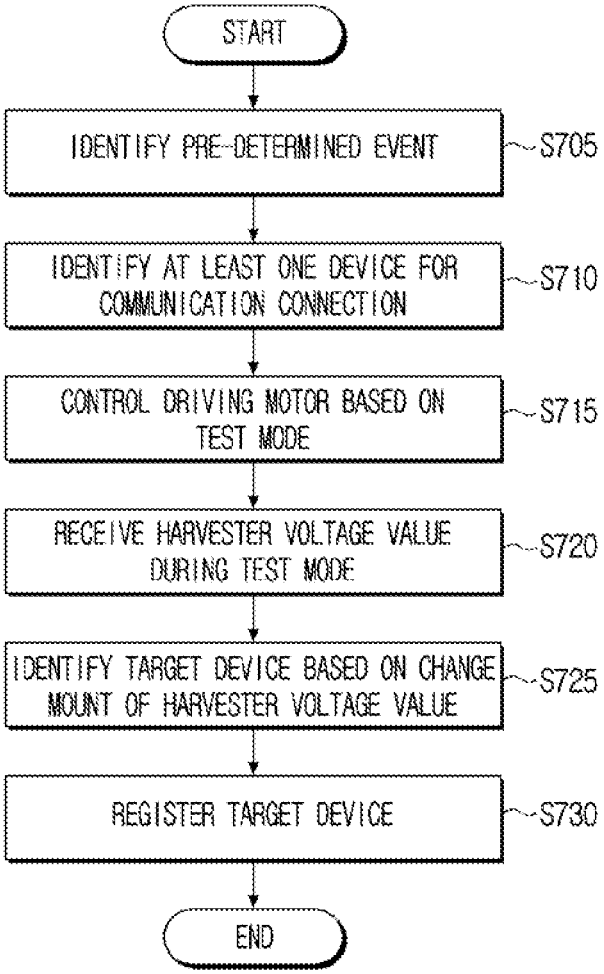
FIG. 7 is a block diagram illustrating the detailed operation of FIG. 6 according to an embodiment of the present disclosure.

FIG. 7 is a block diagram illustrating the detailed operation of FIG. 6.

Referring to FIG. 7, the dry apparatus 100 may identify a predetermined event in operation S705. Here, the predetermined event may be an event for receiving a user input for registering a targeted apparatus corresponding to the dry apparatus 100.

In addition, the dry apparatus 100 may identify at least one device capable of communication connection in operation S710. Here, the device capable of communicating with the dry apparatus 100 may be at least one or more.

In addition, the dry apparatus 100 may control the driving motor 121 based on the test mode in operation S715. Here, the test mode may mean a process for periodically rotating and stopping the drum 122.

Further, the dry apparatus 100 may acquire a harvester voltage value from communicable device in the test mode in operation S720.

In addition, the dry apparatus 100 may identify the targeted apparatus based on the amount of change in the harvester voltage value in operation S725. A specific operation related to the same will be described later with reference to FIGS. 8 to 13.

In addition, the dry apparatus 100 may register the identified targeted apparatus in operation S730. When the targeted apparatus is registered, the dry apparatus 100 may receive sensing data from the registered targeted apparatus.

Figure 8:
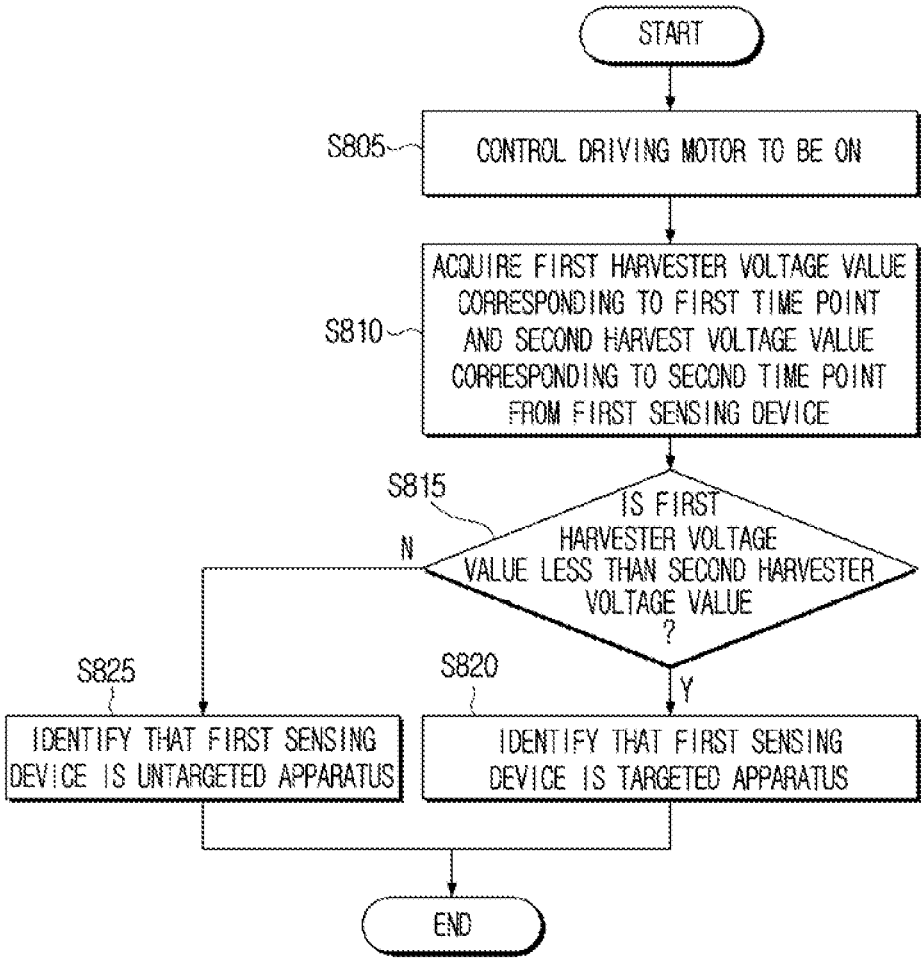
FIG. 8 is a flowchart illustrating a targeted apparatus identification operation according to a driving motor control method according to one or more embodiments.

FIG. 8 is a flowchart illustrating a targeted apparatus identification operation according to a driving motor control method according to one or more embodiments.

Referring to FIG. 8, the dry apparatus 100 may perform a test mode to identify a targeted apparatus. Specifically, the dry apparatus 100 may control the driving motor 121 to be in an on state in operation S805. Here, the dry apparatus 100 may rotate the drum 122.

In addition, the dry apparatus 100 may acquire a first harvester voltage value corresponding to a first time point and a second harvester voltage value corresponding to a second time point from the first sensing device while rotating the drum 122 by controlling the driving motor 121 in operation S810. Here, the first time point may refer to a point in time when the drum 122 is rotated. Here, the second time point may refer to a point in time when a predetermined time has elapsed after the drum 122 is rotated or a time point at which the drum 122 has been rotated and then stopped.

In the meantime, according to an implementation example, it may be replaced with a first time and a second time instead of the first time point and the second time point. Specifically, an average value of a harvester voltage value received at a first time and an average value of a harvester voltage value received at a second time may be acquired.

The dry apparatus 100 may identify whether the first harvester voltage value is less than the second harvester voltage value in operation S815. If the drum 122 rotates, the harvester voltage of the sensing device 200 must be increased. Therefore, if the first harvester voltage value is less than the second harvester voltage value in operation S815-Y, the dry apparatus 100 may identify that the first sensing device is a targeted apparatus in operation S820. In addition, when the first harvester voltage value is equal to or greater than the second harvester voltage value in operation S815-N, the dry apparatus 100 may identify that the first sensing device is an untargeted apparatus in operation S825. That is, the dry apparatus 100 may identify that the first sensing device is not a targeted apparatus.

Figure 9:
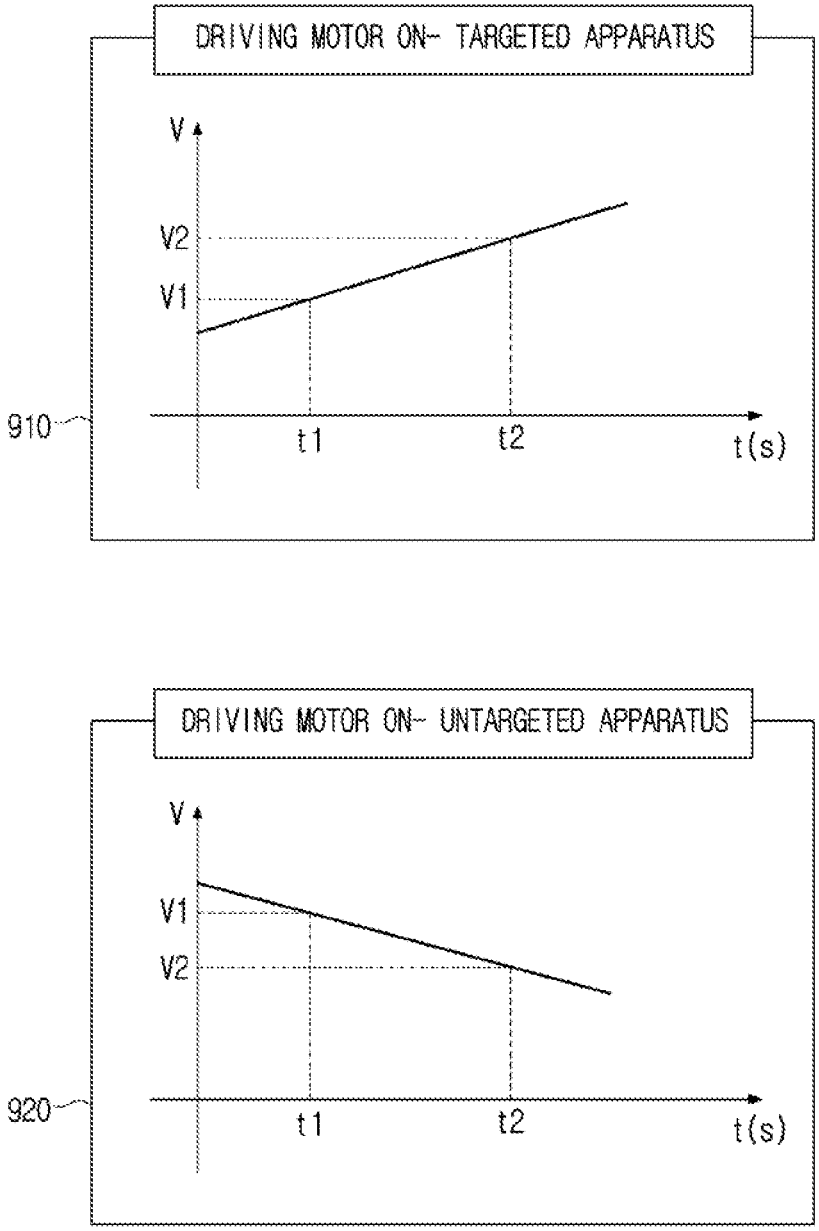
FIG. 9 is a graph illustrating a targeted apparatus and an untargeted apparatus in the embodiment of FIG. 8 according to an embodiment of the present disclosure.

FIG. 9 is a graph illustrating a targeted apparatus and an untargeted apparatus in the embodiment of FIG. 8.

Referring to FIG. 9, a graph 910 may indicate a harvester voltage value of a targeted apparatus (sensing device 200) while the driving motor 121 is in an on state. The dry apparatus 100 may acquire a first harvester voltage value v1 at a first time point t1 and a second harvester voltage value v2 at a second time point t2. When the driving motor 121 is turned on, the drum 122 is rotated, and thus the targeted apparatus located inside the drum 122 may acquire energy. Therefore, the harvester voltage value acquired from the targeted apparatus may also increase.

In addition, the graph 920 may indicate a harvester voltage value of the untargeted apparatus while the driving motor 121 is in an on state. Here, it is assumed that the untargeted apparatus is present outside the dry apparatus 100. The dry apparatus 100 may acquire a first harvester voltage value v1 at a first time point t1 and a second harvester voltage value v2 at a second time point t2. Here, even if the driving motor 121 is in an on state, the untargeted apparatus which is not located inside the drum 122 may lose energy. Therefore, the harvester voltage value acquired from the untargeted apparatus may be reduced.

Figure 10:
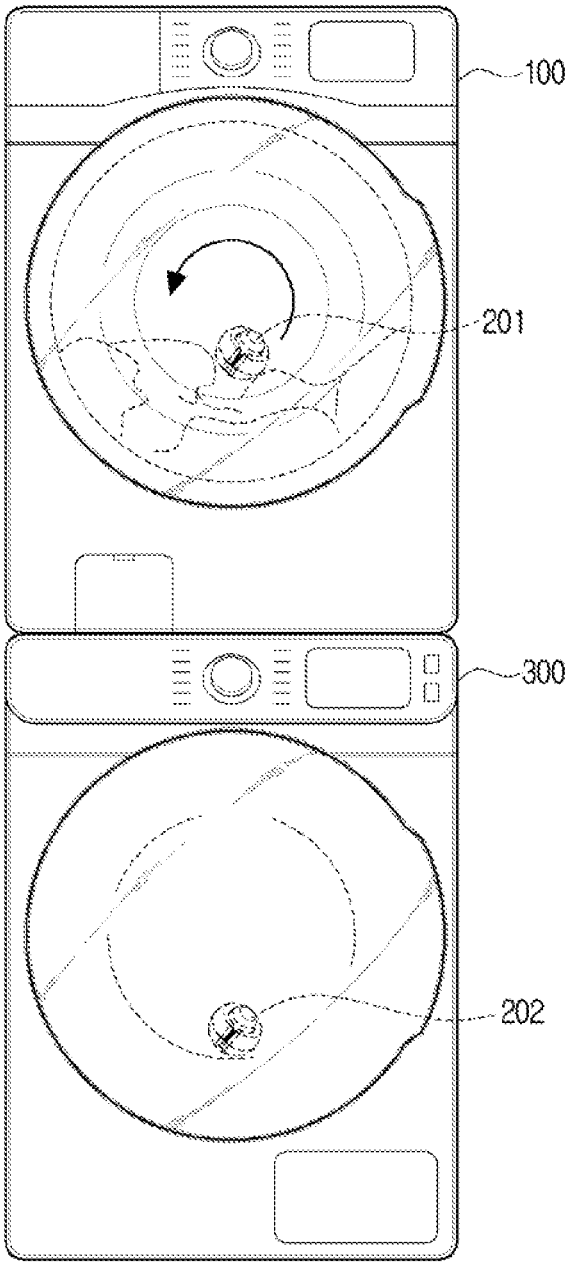
FIG. 10 is a diagram illustrating a targeted apparatus and an untargeted apparatus illustrated in FIG. 8 according to an embodiment of the present disclosure.

FIG. 10 is a diagram illustrating a targeted apparatus and an untargeted apparatus in the embodiment of FIG. 8.

Referring to FIG. 10, both a targeted apparatus and an untargeted apparatus may be identified in a process of identifying a device capable of communicating with the dry apparatus 100. This is because the dry apparatus 100 and the washing machine 300 may be arranged in close proximity. It is assumed that a first sensing device 201 is present inside the dry apparatus 100 and a second sensing device 202 is present inside the washing machine 300. In the standpoint of the dry apparatus 100, the first sensing device 201 may be a targeted apparatus, and the second sensing device 202 may be an untargeted apparatus.

Here, it is assumed that the drum 122 of the dry apparatus 100 rotates, but the drum (not shown) of the washing machine 300 does not rotate. The harvester voltage value of the first sensing device 201 may rise like the graph 910 of FIG. 9. In addition, the harvester voltage value of the second sensing device 202 may descend as in the graph 920 of FIG. 9.

Figure 11:
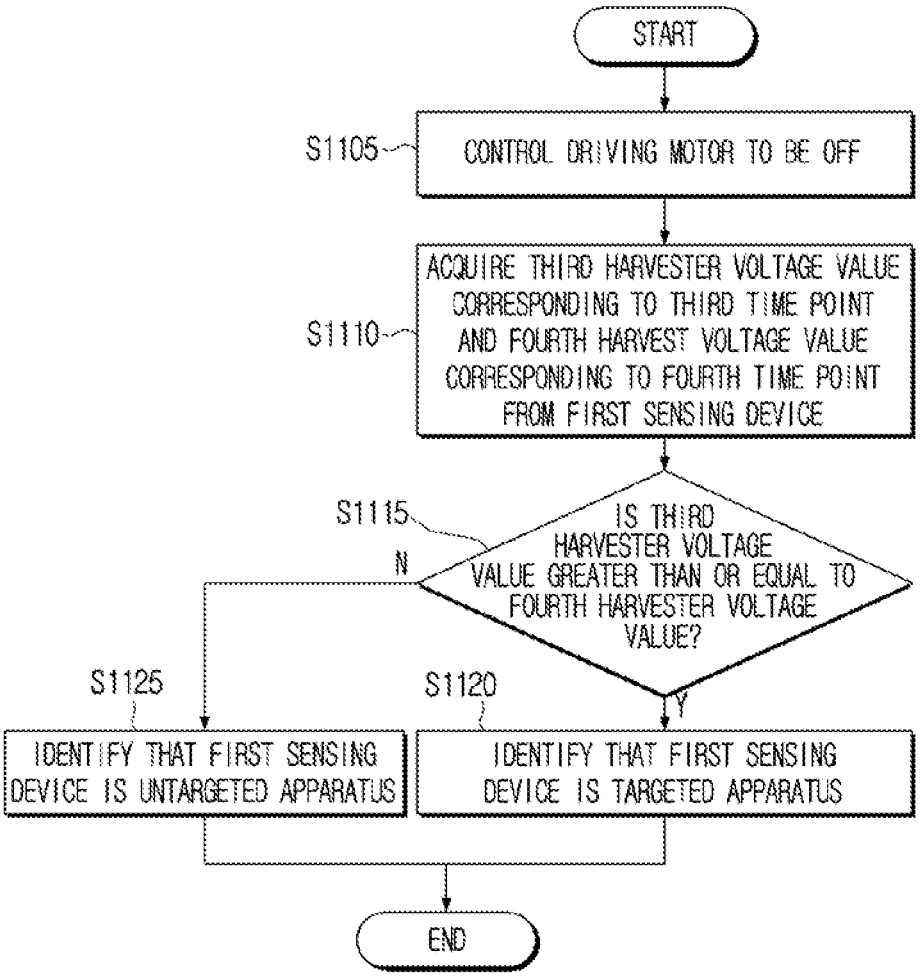
FIG. 11 is a flowchart illustrating a targeted apparatus identification operation according to a driving motor control method according to another embodiment.

FIG. 11 is a flowchart illustrating a targeted apparatus identification operation according to a driving motor control method according to another embodiment.

Referring to FIG. 11, the dry apparatus 100 may perform a test mode to identify a targeted apparatus. Specifically, the dry apparatus 100 may control the driving motor 121 to be in an off state in operation S1105. The dry apparatus 100 may stop the rotation of the drum 122.

Also, the dry apparatus 100 may acquire a third harvester voltage value corresponding to a third time point and a fourth harvester voltage value corresponding to a fourth time point from the first sensing device while stopping the rotation of the drum 122 by controlling the driving motor 121 in operation S1110. Here, the third time point may mean a point in time when the drum 122 stops rotating. Here, the fourth time point may refer to a point in time when a predetermined time has elapsed after the rotation of the drum 122 is stopped or a point in time when the drum 122 has stopped and then rotates.

In the meantime, according to an implementation example, it may be replaced with a third time and a fourth time instead of the third time point and the fourth time point. Specifically, the average value of the harvester voltage value received at the third time and the harvester voltage value received at the fourth time may be acquired.

In addition, the dry apparatus 100 may identify whether the third harvester voltage value is equal to or greater than a fourth harvester voltage value in operation S1115. If the drum 122 is stopped, the harvester voltage of the sensing device 200 should descend. Therefore, if the third harvester voltage value is equal to or greater than the fourth harvester voltage value in operation S1115-Y, the dry apparatus 100 may identify that the first sensing device is a targeted apparatus in operation S1120. In addition, if the third harvester voltage value is less than the fourth harvester voltage value in operation S1115-N, the dry apparatus 100 may identify that the first sensing device is an untargeted apparatus in operation S1125. That is, the dry apparatus 100 may identify that the first sensing device is not a targeted apparatus.

Figure 12:
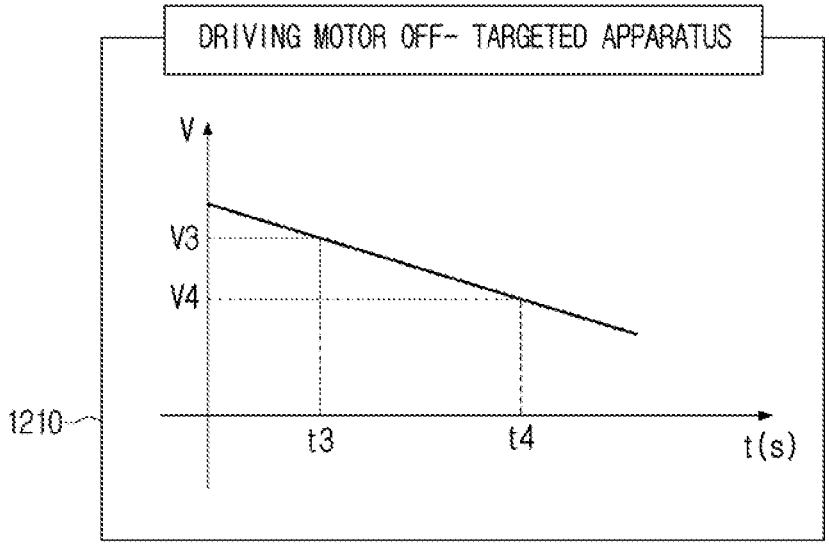
FIG. 12 is a graph illustrating a targeted apparatus and an untargeted apparatus illustrated in FIG. 11 according to an embodiment of the present disclosure.
Figure 12:
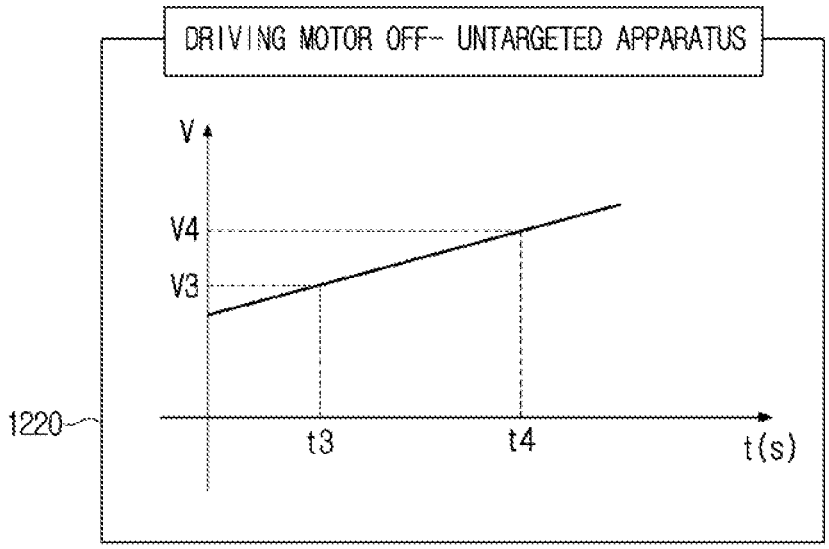

FIG. 12 is a graph illustrating a targeted apparatus and an untargeted apparatus in the embodiment of FIG. 11.

Referring to FIG. 12, a graph 1210 may indicate a harvester voltage value of a targeted apparatus (sensing device 200) while the driving motor 121 is in an off state. The dry apparatus 100 may acquire a third harvester voltage value (v3) at a third time point (t3), and may acquire a fourth harvester voltage value (v4) at a fourth time point (t4). When the driving motor 121 is turned on, the rotation of the drum 122 is stopped, and thus the targeted apparatus located inside the drum 122 may consume energy. Therefore, the harvester voltage value acquired from the targeted apparatus may also be reduced.

In addition, the graph 1220 may indicate a harvester voltage value of the untargeted apparatus while the driving motor 121 is in an off state. Here, it is assumed that the untargeted apparatus is present outside the dry apparatus 100. The dry apparatus 100 may acquire a third harvester voltage value (v3) at a third time point (t3), and may acquire a fourth harvester voltage value (v4) at a fourth time point (t4). Here, even if the driving motor 121 is in an off state, an untargeted apparatus not positioned inside the drum 122 may acquire energy. Therefore, the harvester voltage value acquired from the untargeted apparatus may be increased.

Figure 13:
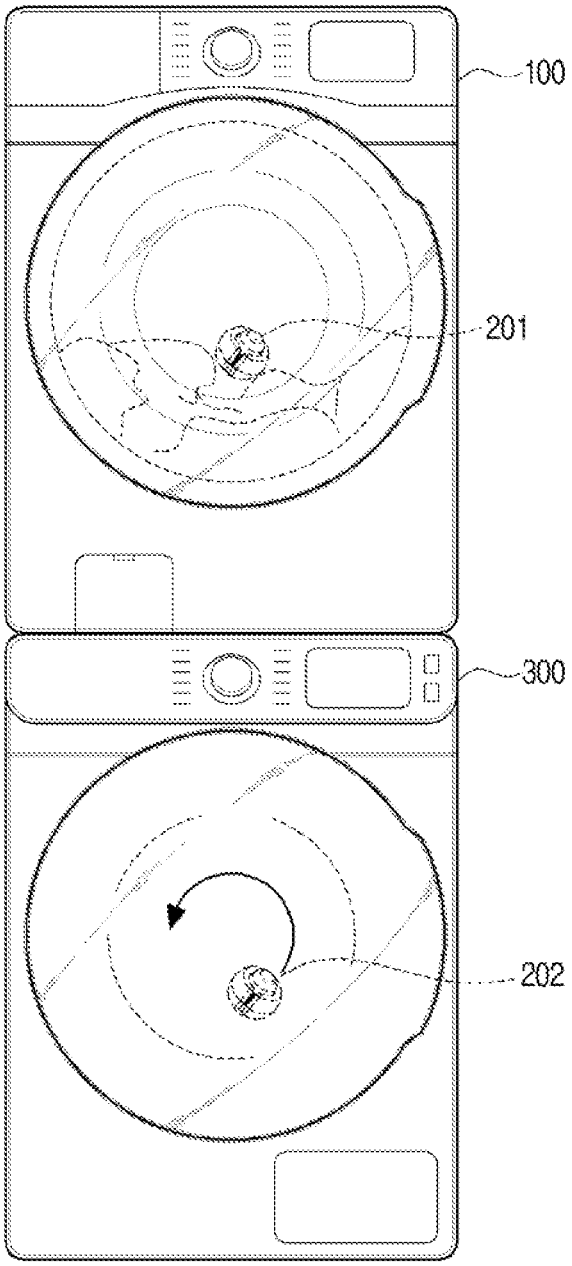
FIG. 13 is a diagram illustrating a targeted apparatus and an untargeted apparatus illustrated in FIG. 11 according to an embodiment of the present disclosure.

FIG. 13 is a diagram illustrating a targeted apparatus and an untargeted apparatus in the embodiment of FIG. 11.

Referring to FIG. 13, both a targeted apparatus and an untargeted apparatus may be identified in a process of identifying a device capable of communicating with the dry apparatus 100. This is because the dry apparatus 100 and the washing machine 300 may be arranged in close proximity. It is assumed that a first sensing device 201 exists inside the dry apparatus 100 and a second sensing device 202 is present inside the washing machine 300. In the standpoint of the dry apparatus 100, the first sensing device 201 may be a targeted apparatus, and the second sensing device 202 may be an untargeted apparatus.

Here, it is assumed while the drum 122 of the dry apparatus 100 is stopped, a drum (not shown) of the washing machine 300 rotates. The harvester voltage value of the first sensing device 201 may be dropped as in the graph 1210 of FIG. 12. In addition, the harvester voltage value of the second sensing device 202 may rise like the graph 1220 of FIG. 12.

Figure 14:
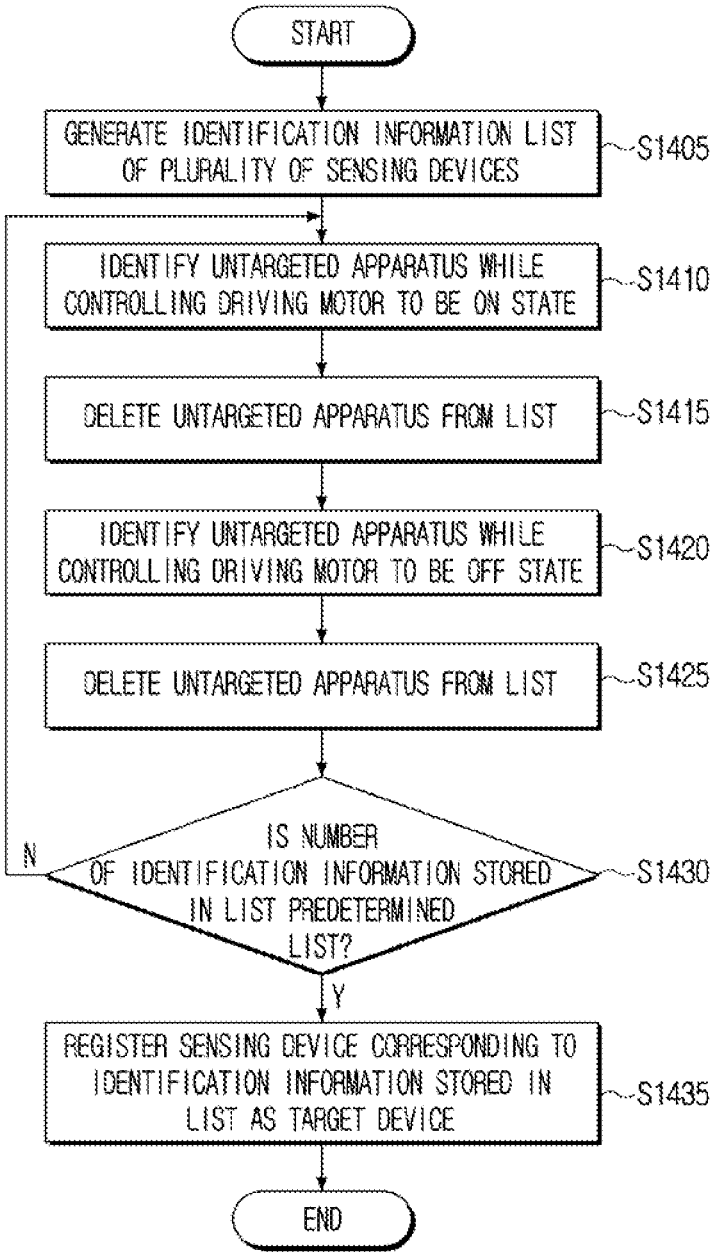
FIG. 14 is a flowchart illustrating an operation of generating an identification information list and identifying a targeted apparatus according to an embodiment of the present disclosure.

FIG. 14 is a flowchart illustrating an operation of generating an identification information list and identifying a targeted apparatus.

Referring to FIG. 14, the dry apparatus 100 may generate an identification information list of a plurality of sensing devices in operation S1405. Here, the identification information list may include identification information of devices capable of communicating with the dry apparatus 100.

In addition, the dry apparatus 100 may identify an untargeted apparatus while controlling the driving motor 121 in an on state in operation S1410. Specifically, the dry apparatus 100 may identify a targeted apparatus and an untargeted apparatus based on a harvester voltage value of each of a plurality of sensing devices received while the driving motor 121 is turned on.

In addition, the dry apparatus 100 may delete the identification information corresponding to the untargeted apparatus from the identification information list generated in operation S1405. This is because the untargeted apparatus does not need to be registered with the dry apparatus 100.

In addition, the dry apparatus 100 may identify an untargeted apparatus while controlling the driving motor 121 in an off state in operation S1420. Specifically, the dry apparatus 100 may identify a targeted apparatus and an untargeted apparatus based on a harvester voltage value of each of a plurality of sensing devices received while the driving motor 121 is turned off.

The dry apparatus 100 may delete identification information corresponding to the untargeted apparatus from the identification information list in operation S1425.

In addition, the dry apparatus 100 may identify whether the number of identification information stored in the identification information list is a predetermined number in operation S1430. Here, the predetermined number may mean the number of targeted apparatuses corresponding to the dry apparatus 100, and may be a predetermined number. For example, when the sensing device 200 for the dry apparatus 100 is one, the predetermined number may be 1.

Here, if the number of identification information stored in the identification information list is a predetermined number in operation S1430-Y, the dry apparatus 100 may register a sensing device corresponding to the identification information stored in the identification information list as a targeted apparatus in operation S1435. In addition, if the number of identification information stored in the identification information list is not the predetermined number in operation S1430-N, the dry apparatus 100 may repeat operations S1410 to S1430 to delete the untargeted apparatus from the list by controlling the driving motor to be turned on or off.

Figure 15:
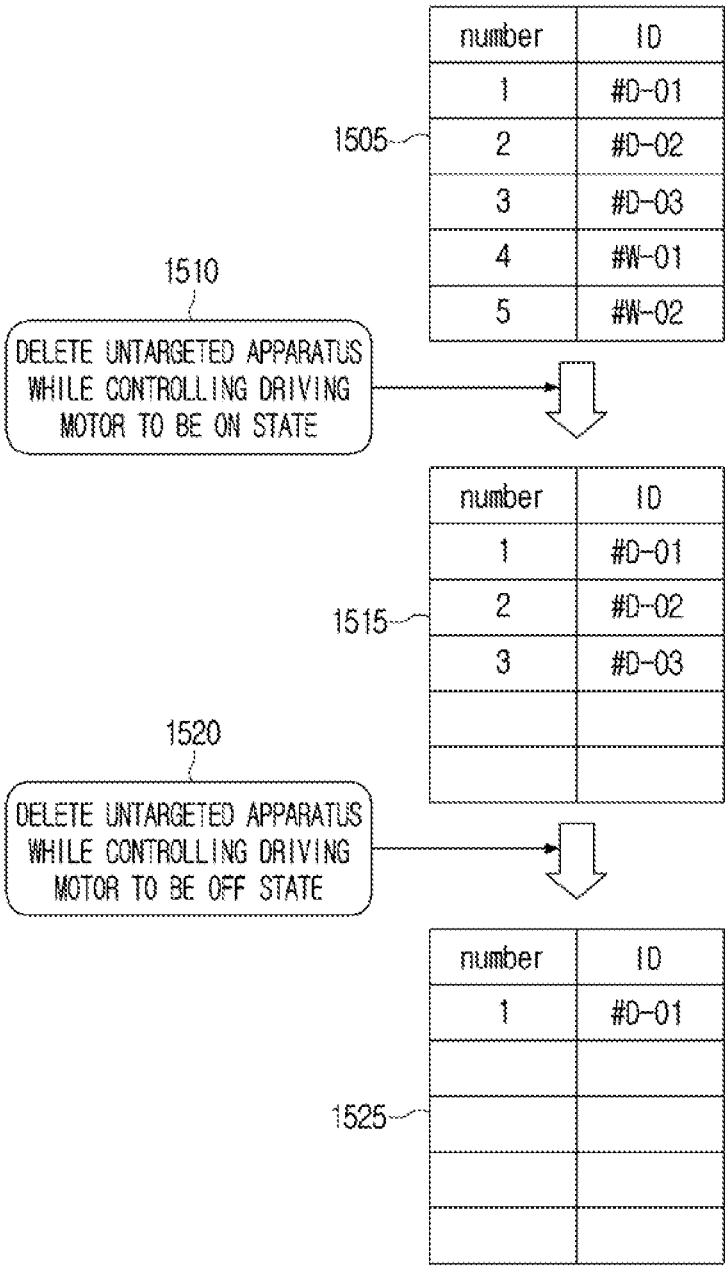
FIG. 15 is a diagram illustrating an operation of changing an identification information list illustrated in FIG. 14 according to an embodiment of the present disclosure.

FIG. 15 is a diagram illustrating an operation of changing an identification information list in the embodiment of FIG. 14.

Referring to FIG. 15, a list 1505 may refer to an identification information list generated in operation S1405 of FIG. 14. Here, the list 1505 may include identification information (#D-01, #D-02, #D-03, #W-01, #W-02) of five devices capable of communicating in the dry apparatus 100.

Further, the dry apparatus 100 may delete the untargeted apparatus while controlling the driving motor to an on-state (1510). Here, the untargeted apparatus is assumed to be #W-01, #W-02.

Here, the list 1515 may mean a list in which the untargeted apparatus is primarily deleted from the list 1505. Specifically, the list 1515 may refer to an identification information list after the operation S1415 of FIG. 14 is performed.

In addition, the dry apparatus 100 may delete an untargeted apparatus while controlling the driving motor in an off state 1520. Here, it is assumed that the untargeted apparatus is #D-02, #D-03.

Here, the list 1525 may mean a list in which the untargeted apparatus is secondarily deleted from the list 1515. Specifically, the list 1525 may refer to an identification information list after the operation S1425 of FIG. 14 is performed.

Figure 16:
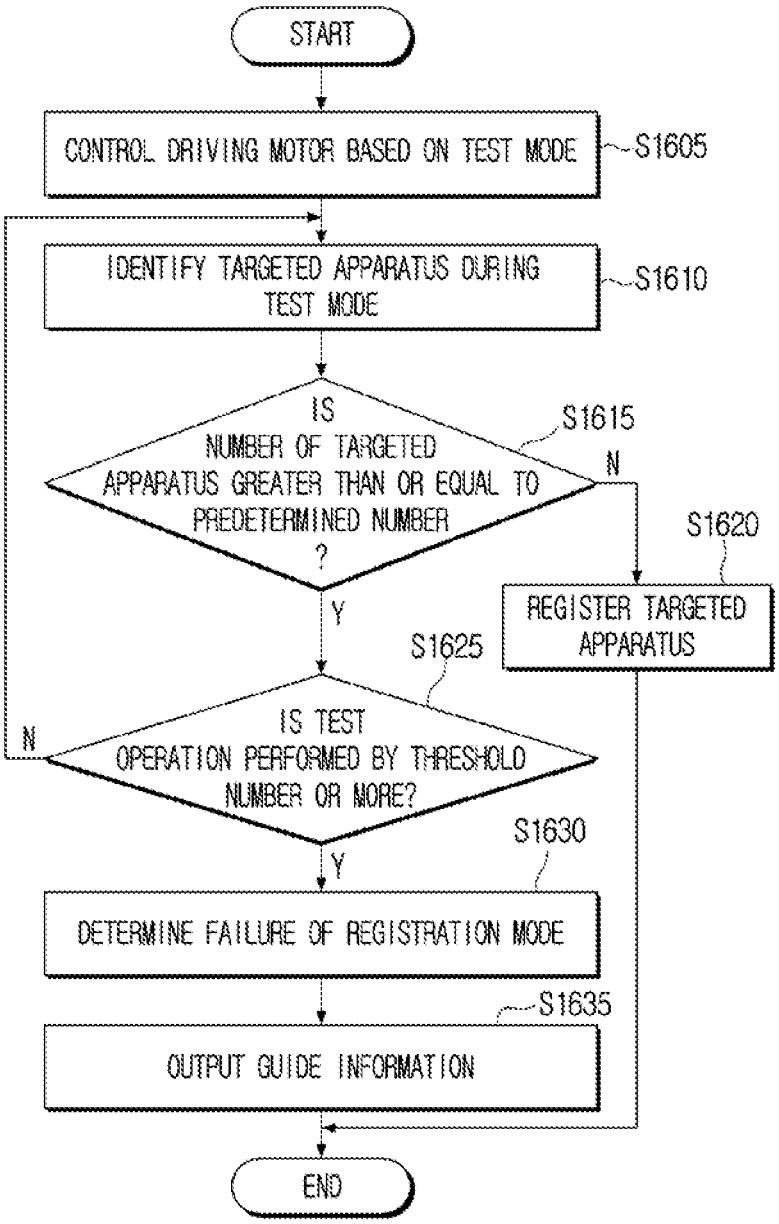
FIG. 16 is a diagram illustrating an operation in which a test operation is repeated according to an embodiment of the present disclosure.

FIG. 16 is a diagram illustrating an operation in which a test operation is repeated.

Referring to FIG. 16, the dry apparatus 100 may control the driving motor 121 based on a test mode in operation S1605. In addition, the dry apparatus 100 may identify the targeted apparatus during a test mode in operation S1610. In addition, the dry apparatus 100 may identify whether the targeted apparatus is greater than or equal to a predetermined number in operation S1615.

Here, if the targeted apparatus is less than the predetermined number in operation S1615-N, the dry apparatus 100 may register the targeted apparatus in operation S1620. If the targeted apparatus is greater than or equal to the predetermined number in operation S1615-Y, the dry apparatus 100 may identify whether the test operation is performed a threshold number of times or more in operation S1625. The threshold number of times may be changed by a user setting.

Here, if the test operation has not been performed a threshold number of times or more in operation S1625-N, the dry apparatus 100 may perform operations S1605 to S1625 to repeatedly identify the targeted apparatus in the test mode.

Here, if the test operation has been performed more than a threshold number of times in operation S1625-Y, the dry apparatus 100 may determine that the registration mode has failed in operation S1630. The dry apparatus 100 may output guide information corresponding to the failure of the registration mode in operation S1635. Specifically, the guide information may be image data or audio data. Here, the dry apparatus 100 may output image data through the display 140 or output audio data through the speaker 160. For example, the guide information corresponding to the failure of the registration mode may be an UI 1811 of FIG. 18.

Figure 17:
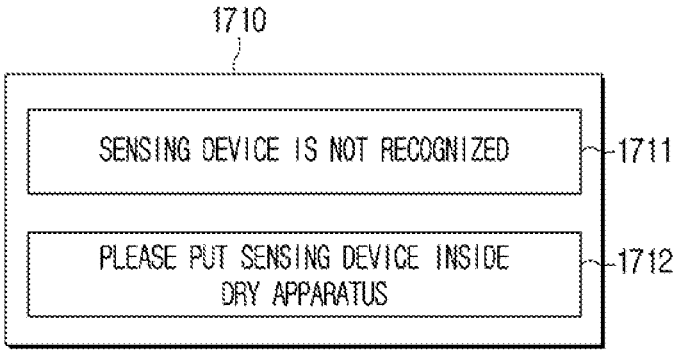
FIG. 17 is a diagram illustrating guide information according to one or more embodiments.

FIG. 17 is a diagram illustrating guide information according to one or more embodiments.

Referring to FIG. 17, the guide information 1710 may include at least one of information 1711 indicating that the sensing device is not recognized or information 1712 including instructions to put the sensing device into the dry apparatus 100.

Here, the dry apparatus 100 may display guide information 1710 through the display 140. According to one or more embodiments, the dry apparatus 100 may output guide information 1710 through the speaker 160.

Figure 18:
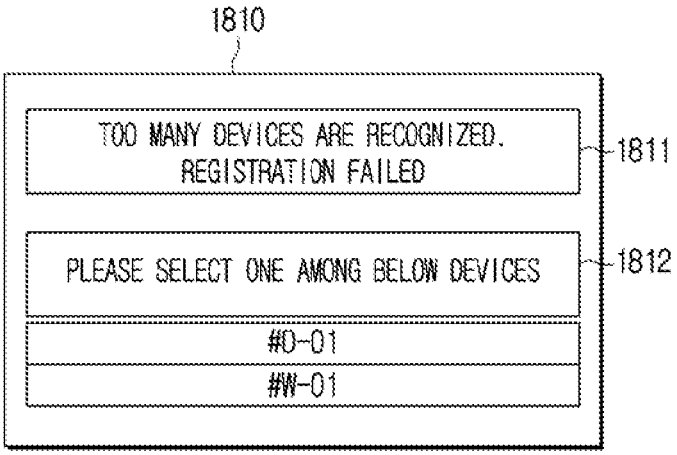
FIG. 18 is a diagram illustrating guide information according to another embodiment.

FIG. 18 is a diagram illustrating guide information according to another embodiment.

Referring to FIG. 18, guide information 1810 may include at least one of information 1811 indicating that a sensing device is recognized by exceeding a predetermined number or information 1812 for selecting one of a plurality of devices as a targeted apparatus.

The dry apparatus 100 may display guide information 1810 through the display 140. According to one or more embodiments, the dry apparatus 100 may output guide information 1810 through the speaker 160.

Figure 19:
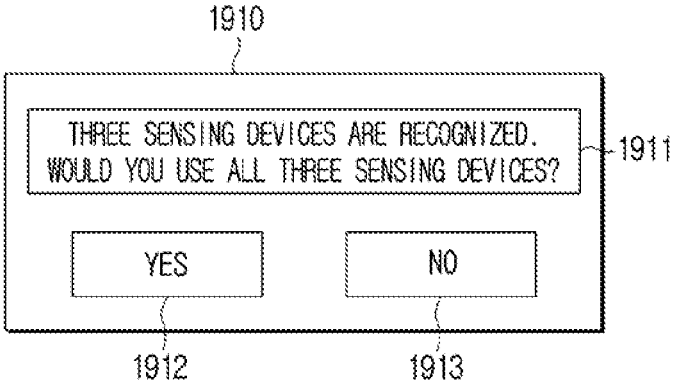
FIG. 19 is a diagram illustrating guide information according to still another embodiment.

FIG. 19 is a diagram illustrating guide information according to still another embodiment.

Referring to FIG. 19, guide information 1910 may include information 1911 and user response information 1912, 1913 for making a user confirm the number of identified targeted apparatuses. For example, the information 1911 for making a user confirm the number of identified targeted apparatuses may include inquiry sentences such as "Three sensing devices are recognized. Do you want to use all three sensing devices?"

Here, when a user input for selecting positive response information 1912 is identified, the dry apparatus 100 may register a plurality of currently identified sensing devices as a targeted apparatus. In addition, when a user input for selecting negative response information 1913 is identified, the dry apparatus 100 may determine that the registration mode has failed without registering the plurality of sensing devices as the targeted apparatus.

Figure 20:
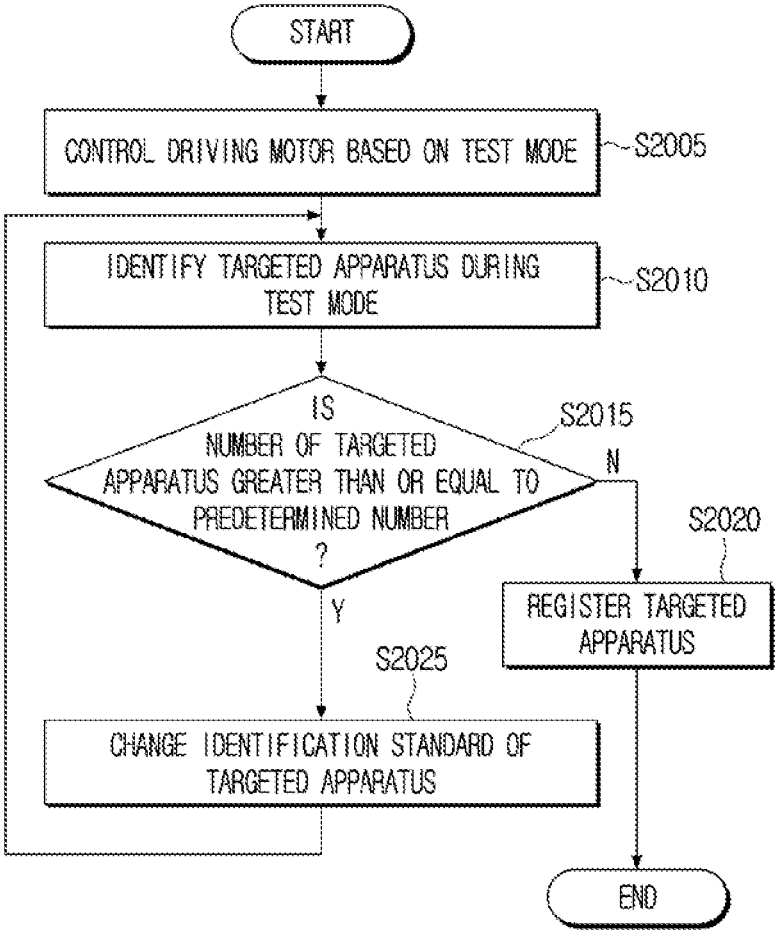
FIG. 20 is a flowchart illustrating an operation of changing an identification reference of a targeted apparatus according to an embodiment of the present disclosure.

FIG. 20 is a flowchart illustrating an operation of changing an identification reference of a targeted apparatus.

Referring to FIG. 20, the dry apparatus 100 may control the driving motor 121 based on a test mode in operation S2005. The dry apparatus 100 may identify the targeted apparatus while the test mode is performed in operation S2010. In addition, the dry apparatus 100 may identify whether the targeted apparatus is greater than or equal to a predetermined number in operation S2015.

Here, if the targeted apparatus is less than the predetermined number in operation S2015-N, the dry apparatus 100 may register the currently identified targeted apparatus in operation S2020.

Here, if the targeted apparatus is equal to or greater than a predetermined number in operation S2015-Y, the dry apparatus 100 may change an identification criterion of the targeted apparatus in operation S2025. A detailed description related to the same will be described later with reference to FIG. 21.

The dry apparatus 100 may repeat the steps S2005, S2010, S2015, and S2025 until the targeted apparatus becomes less than a predetermined number.

Figure 21:
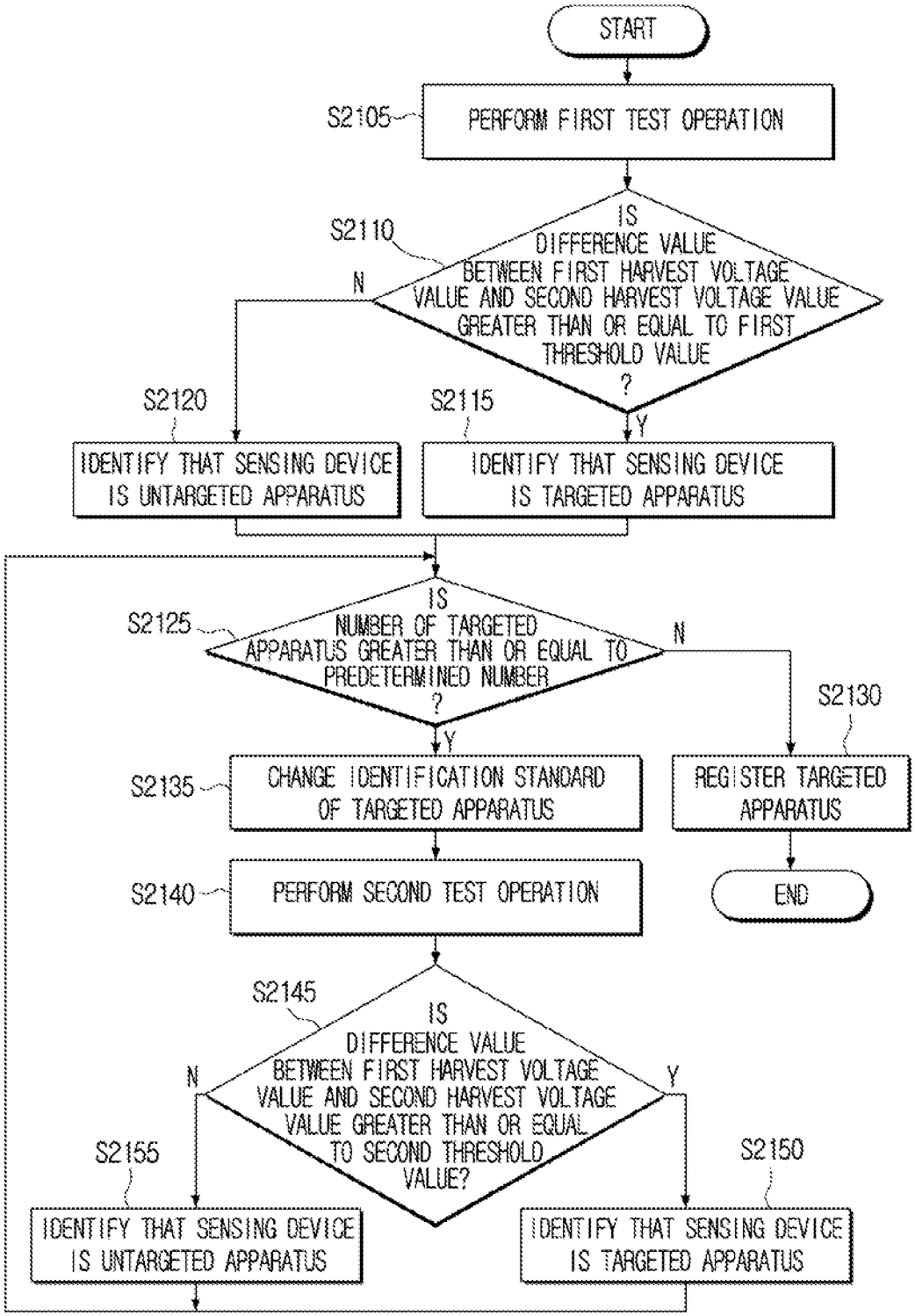
FIG. 21 is a flowchart for describing the detailed operation of FIG. 20 according to an embodiment of the present disclosure.

FIG. 21 is a flowchart for describing the detailed operation of FIG. 20.

Referring to FIG. 21, the dry apparatus 100 may perform a first test operation in operation S2105. In the previous description, it has been described that a test operation controls the driving motor 121 in an on state and then controls the driving motor 121 in an off state. However, in FIG. 21, a case in which the driving motor 121 is turned on is limited to simplify the description.

Here, the dry apparatus 100 may acquire a first harvester voltage value and a second harvester voltage value while a first test operation is performed.

Here, the dry apparatus 100 may identify whether the difference value between the first harvester voltage value and the second harvester voltage value is greater than or equal to a first threshold value in operation S2110. Here, when the difference value between the first harvester voltage value and the second harvester voltage value is equal to or greater than a first threshold value in operation S2110-Y, the dry apparatus 100 may identify that the sensing device is a targeted apparatus. In addition, when a difference value between the first harvester voltage value and the second harvester voltage value is less than a first threshold value in operation S2110-N, the dry apparatus 100 may identify that the sensing device is an untargeted apparatus in operation S2120.

The dry apparatus 100 may identify whether the targeted apparatus is greater than or equal to a predetermined number after operations S2115 and S2120 in operation S2125. Here, if the targeted apparatus is less than the predetermined number in operation S2125-N, the dry apparatus 100 may register the targeted apparatus in operation S2130. Meanwhile, if the targeted apparatus is equal to or greater than a predetermined number in operation S2125-Y, the dry apparatus 100 may change an identification criterion of the targeted apparatus in operation S2125. Specifically, a first threshold value used in operation S2110 may be changed to a second threshold value. Here, the second threshold value may be a value greater than the first threshold value.

Here, the dry apparatus 100 may perform a second test operation in operation S2140. Here, the dry apparatus 100 may acquire a first harvester voltage value and a second harvester voltage value while a second test operation is performed.

Here, the dry apparatus 100 may identify whether the difference value between the first harvester voltage value and the second harvester voltage value is greater than or equal to a second threshold value in operation S2145. Here, if the difference value between the first harvester voltage value and the second harvester voltage value is equal to or greater than a second threshold value in operation S2145-Y, the dry apparatus 100 may identify that the sensing device is a targeted apparatus in operation S2150. In addition, if the difference value between the first harvester voltage value and the second harvester voltage value is less than a second threshold value in operation S2145-N, the dry apparatus 100 may identify that the sensing device is an untargeted apparatus in operation S2155.

The dry apparatus 100 may identify whether the targeted apparatus is greater than or equal to a predetermined number after operation S2115 and S2120 in operation S2125. The dry apparatus 100 may repeat operations of S2125, S2135, S2140, S2145, S2150, and S2155 until the targeted apparatus becomes less than a predetermined number. Specifically, the dry apparatus 100 may continue to increase a threshold (e.g., a first threshold and a second threshold) used to identify the targeted apparatus. When the threshold value is gradually increased, a difference value between the first harvester voltage value and the second harvester voltage value should also need to be increased, and thus a targeted apparatus among a plurality of devices may be clearly distinguished.

Figure 22:
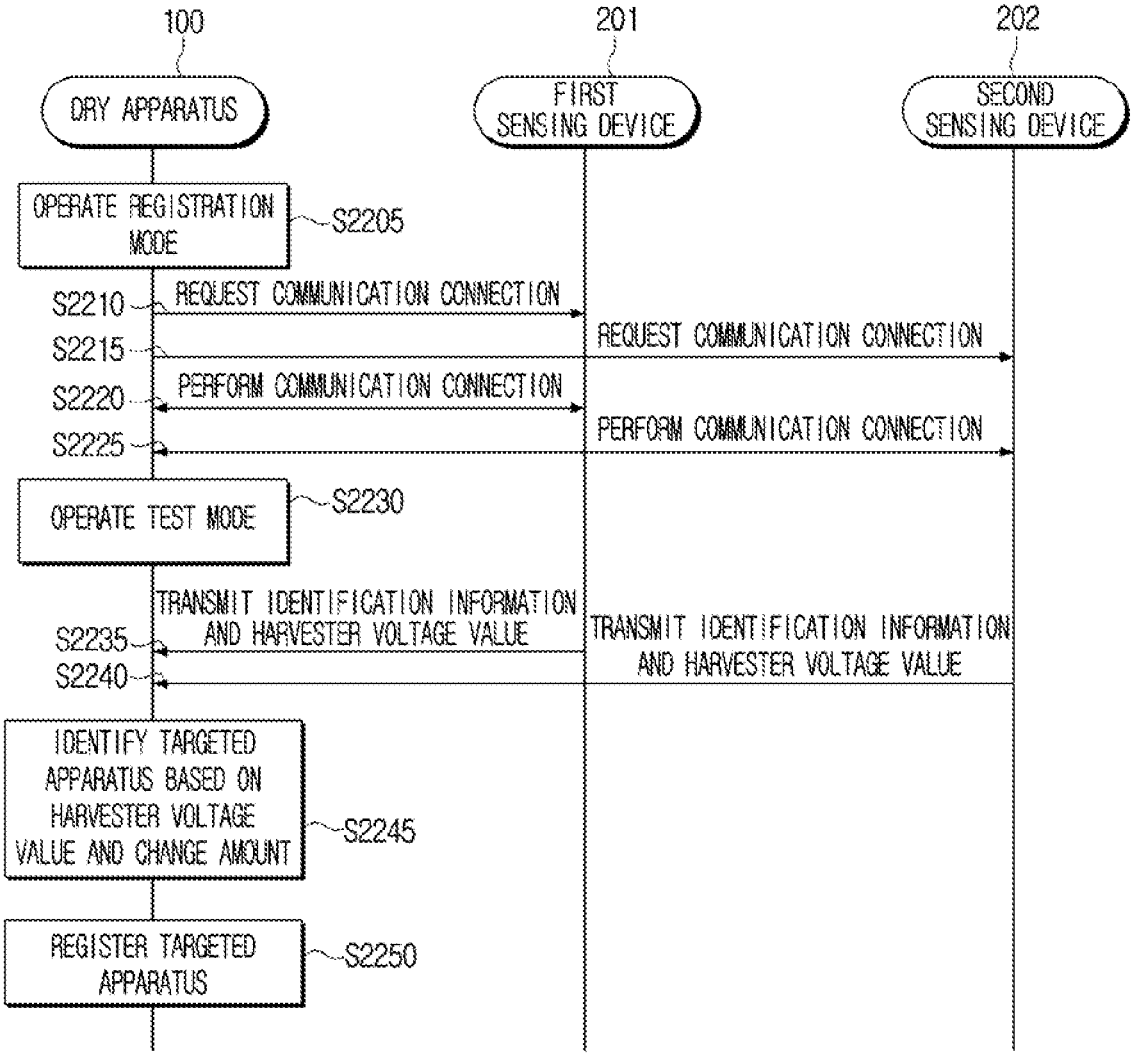
FIG. 22 is a flowchart for describing a registration mode according to one or more embodiments.

FIG. 22 is a flowchart for describing a registration mode according to one or more embodiments.

Referring to FIG. 22, the dry apparatus 100 may operate in a registration mode based on a user input in operation S2205. Here, the registration mode may mean a mode for performing an operation of storing the sensing device in the memory 150 as a targeted apparatus corresponding to the dry apparatus 100. Specifically, the registration mode may mean a mode for performing a process of determining and storing a targeted apparatus (sensing device) for transmitting sensing data used to control the process of the dry apparatus 100.

The dry apparatus 100 may search for a device capable of communicating with the dry apparatus 100 in a broadcasting method at a start step of performing a registration mode. Specifically, the dry apparatus 100 may transmit a signal for requesting a communication connection to the first sensing device 201 in operation S2210, and may transmit a signal for requesting a communication connection to the second sensing device 202 in operation S2215. The dry apparatus 100 and the first sensing device 201 may perform communication connection based on the response of the first sensing device 201 in operation S2220, and the dry apparatus 100 and the second sensing device 202 may perform communication connection base on the response of the second sensing device 202 in operation S2225. Here, the meaning of performing the communication connection may be the meaning of establishing a communication session.

The dry apparatus 100 may operate in a test mode when a communication connection with at least one sensing device is performed and a predetermined time elapses in operation S2230. Here, the test mode may mean a mode for controlling the driving motor 121 to identify a targeted apparatus in a plurality of devices (a first sensing device 201 and a second sensing device 202) in which communication connection with the dry apparatus 100 is performed. Specifically, the test mode may refer to a mode in which an operation of controlling the driving motor 121 to rotate the drum 122 by a predetermined time or stopping the drum 122 by a predetermined time is repeated. Here, the targeted apparatus may refer to a device for receiving sensing data used for a drying process of the dry apparatus 100, and may refer to a device existing inside the drum 122.

The first sensing device 201 may transmit identification information and a harvester voltage value in operation S2235. The second sensing device 202 may transmit identification information and a harvester voltage value in operation S2240.

According to one or more embodiments, the first sensing device 201 and the second sensing device 202 may transmit identification information and a harvester voltage value to the dry apparatus 100, respectively, when a communication connection is performed regardless of whether an operation is started in a test mode.

According to another embodiment, the first sensing device 201 and the second sensing device 202 may transmit the identification information and the harvester voltage value to the dry apparatus 100, respectively, only when a signal indicating that the first sensing device 201 and the second sensing device 202 are operating in a test mode from the dry apparatus 100 or a harvester voltage value request signal is received.

Here, the dry apparatus 100 may identify a targeted apparatus based on the amount of change in the harvester voltage value received from each of the first sensing device 201 and the second sensing device 202 in operation S2245. Specifically, the dry apparatus 100 may analyze the harvester voltage value of the first sensing device 201 by receiving the harvester voltage value of the first sensing device 201 for a predetermined period. The amount of change in the harvester voltage value of the first sensing device 201 may be acquired for a predetermined time, and whether the first sensing device 201 is a targeted apparatus may be identified based on the amount of change in the harvester voltage value of the first sensing device 201. In addition, the dry apparatus 100 may analyze the harvester voltage value of the second sensing device 202 by receiving the harvester voltage value of the second sensing device 202 for a predetermined period. The amount of change in the harvester voltage value of the second sensing device 202 may be acquired for a predetermined time, and whether the second sensing device 202 is a targeted apparatus may be identified based on the amount of change in the harvester voltage value of the second sensing device 202.

The dry apparatus 100 may register the identified device as the targeted apparatus in operation S2250.

Figure 23:
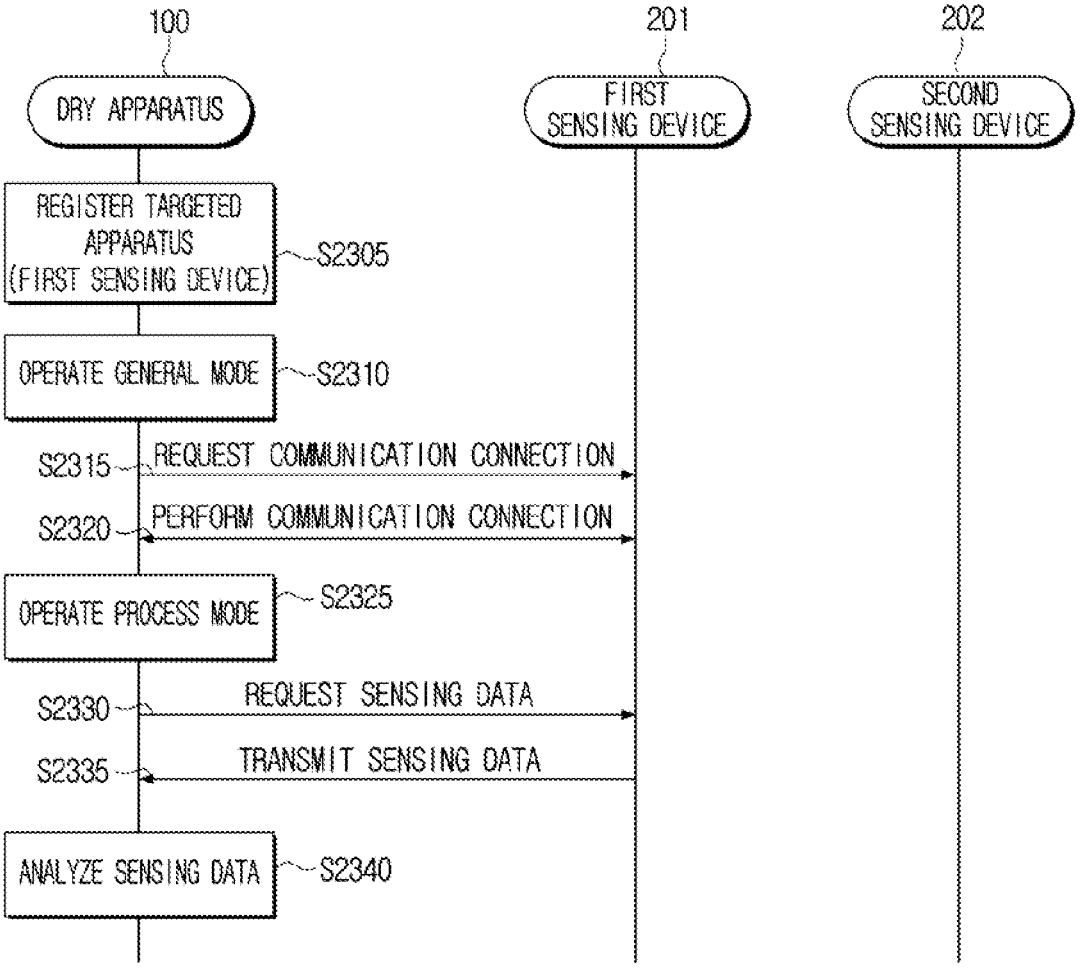
FIG. 23 is a flowchart for describing a normal mode according to one or more embodiments.

FIG. 23 is a flowchart for describing a normal mode according to one or more embodiments.

Referring to FIG. 23, it is assumed that the first sensing device 201 of FIG. 22 is a targeted apparatus. The dry apparatus 100 may register the first sensing device 201 as a targeted apparatus in operation S2305.

The dry apparatus 100 may operate in a normal mode based on a user input or an automatic switching command in operation S2310. Here, the normal mode may mean a mode for waiting to perform a drying process of the dry apparatus 100 after registering the targeted apparatus.

The dry apparatus 100 may request a communication connection to the first sensing device 201, which is a targeted apparatus, based on a control command (user input or automatic switching command) for operating in a normal mode in operation S2315. Here, since the dry apparatus 100 stores identification information corresponding to the first sensing device 201, the dry apparatus 100 may transmit a communication connection request signal only to the first sensing device 201.

The dry apparatus 100 and the first sensing device 201 may perform communication connection based on the response of the first sensing device 201 in operation S2320. Here, operations S2315 and S2320 may be omitted when a communication connection is already performed.

Here, the dry apparatus 100 may operate in a process mode based on a user input in operation S2325. Here, the process mode may mean a mode for performing a drying process.

Here, the dry apparatus 100 may transmit a signal for requesting sensing data to the first sensing device 201 after operating in a process mode in operation S2330. The first sensing device 201 may transmit sensing data to the dry apparatus 100 in operation S2335. In addition, the dry apparatus 100 may analyze the sensing data received from the first sensing device 201 in operation S2340. The dry apparatus 100 may determine a detailed setting of the drying process or change a predetermined detailed setting based on the analyzed result.

In FIG. 23, an embodiment in which the dry apparatus 100 transmits a communication connection signal to only the first sensing device 201 registered as a targeted apparatus is described. However, in the embodiment of FIG. 24, an operation of establishing a communication connection with peripheral devices and distinguishing a targeted apparatus based on the received identification information is described.

Figure 24:
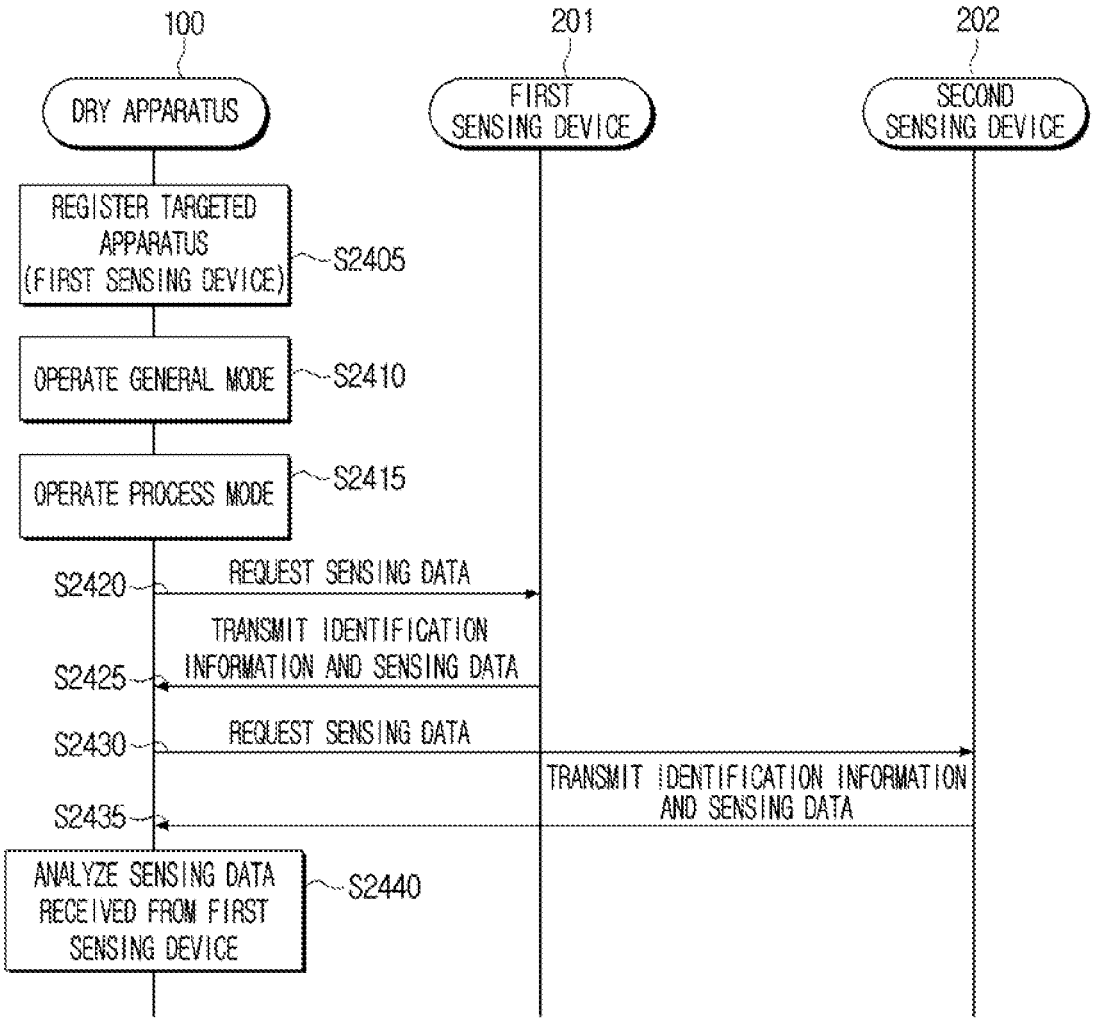
FIG. 24 is a flowchart for describing a normal mode according to another embodiment.

FIG. 24 is a flowchart for describing a normal mode according to another embodiment.

Referring to FIG. 24, the dry apparatus 100 may register the first sensing device 201 as a targeted apparatus in operation S2405. In addition, the dry apparatus 100 may operate in a normal mode based on a user input or an automatic switching command in operation S2410. The dry apparatus 100 may operate in a process mode based on a user input in operation S2415. Here, the description related to the targeted apparatus, the general board, and the process mode has been described with reference to FIGS. 22 and 23, and thus a redundant description thereof will be omitted.

The dry apparatus 100 may transmit a signal requesting the sensing data to the first sensing device 201 in operation S2420. The first sensing device 201 may transmit identification information and sensing data to the dry apparatus 100 in operation S2425.

Further, the dry apparatus 100 may transmit a signal requesting the sensing data to the second sensing device 202 in operation S2430. The second sensing device 202 may transmit the identification information and the sensing data to the dry apparatus 100 in operation S2435.

Here, the dry apparatus 100 may identify the same device as the identification information registered as the targeted apparatus among the identification information of the first sensing device 201 and the identification information of the second sensing device 202. When it is assumed that the first sensing device 201 is registered as a targeted apparatus, the dry apparatus 100 may selectively analyze the sensing data received from the first sensing device 201 in operation S2440.

Figure 25:
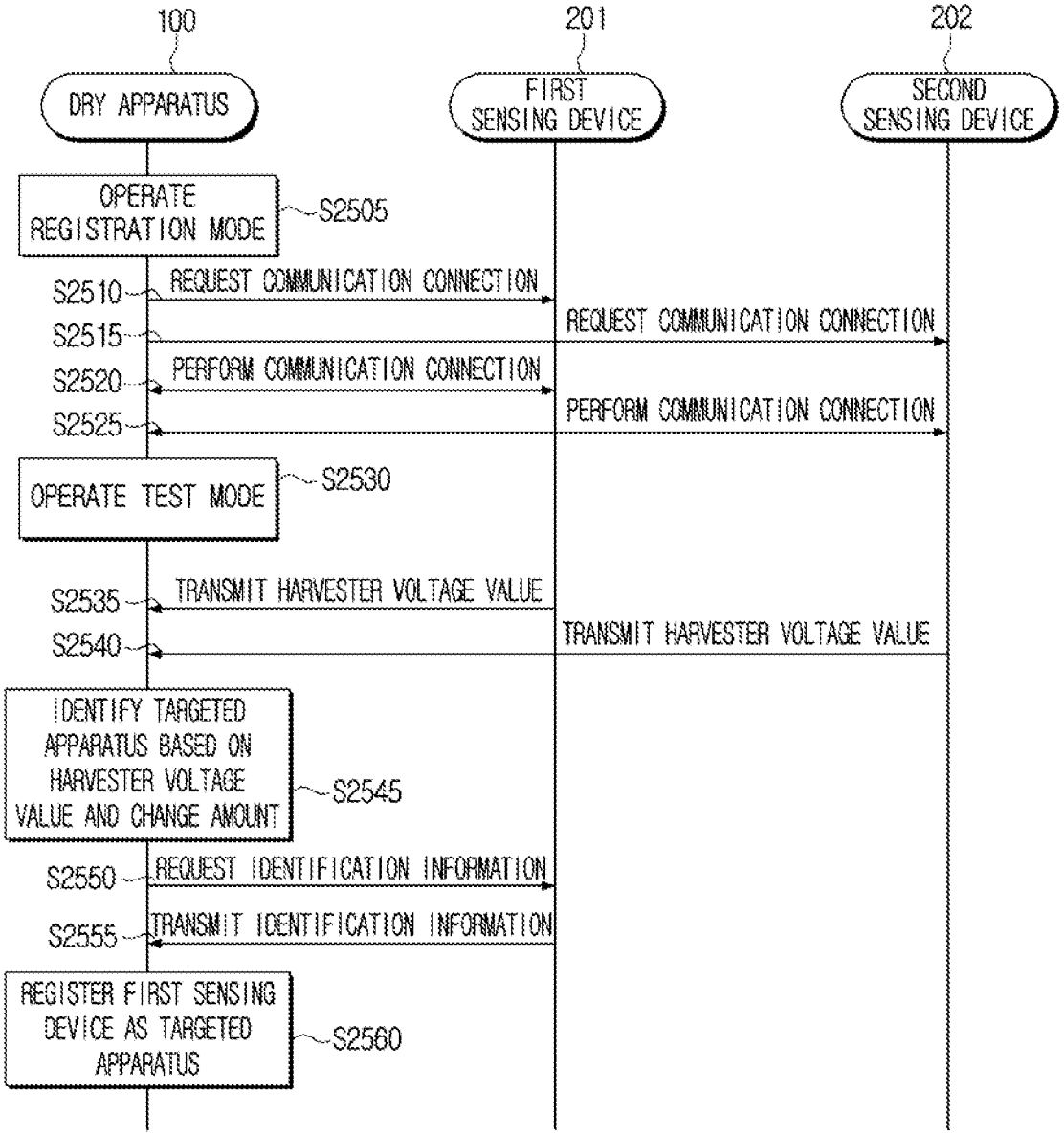
FIG. 25 is a flowchart for describing a registration mode according to another embodiment.

FIG. 25 is a flowchart for describing a registration mode according to another embodiment.

Referring to FIG. 25, operations S2505, S2510, S2515, S2520, S2525, and S2530 may correspond to operations S2205, S2210, S2215, S2220, S2225, S2230 of FIG. 22.

The first sensing device 201 may transmit the harvester voltage value to the dry apparatus 100 in operation S2535. The second sensing device 202 may transmit the harvester voltage value to the dry apparatus 100 in operation S2540.

Here, the dry apparatus 100 may identify the targeted apparatus based on the amount of change in the harvester voltage value in operation S2545. Specifically, the dry apparatus 100 may identify whether the first sensing device 201 is a targeted apparatus based on the amount of change in the harvester voltage value of the first sensing device 201, and the dry apparatus 100 may identify whether the second sensing device 202 is a targeted apparatus based on the amount of change in the harvester voltage value of the second sensing device 202.

Here, it is assumed that the dry apparatus 100 identifies that the first sensing device 201 is a targeted apparatus and identifies that the second sensing device 202 is an untargeted apparatus. Here, the dry apparatus 100 may transmit a signal requesting identification information of the first sensing device 201 to the first sensing device 201 in order to register the first sensing device 201 as a targeted apparatus in operation S2550. The first sensing device 201 may transmit the identification information to the dry apparatus 100 in operation S2555.

Here, the dry apparatus 100 may register the first sensing device 201 as a targeted apparatus based on the identification information of the first sensing device 201 received from the first sensing device 201 in operation S2560.

Figure 26:
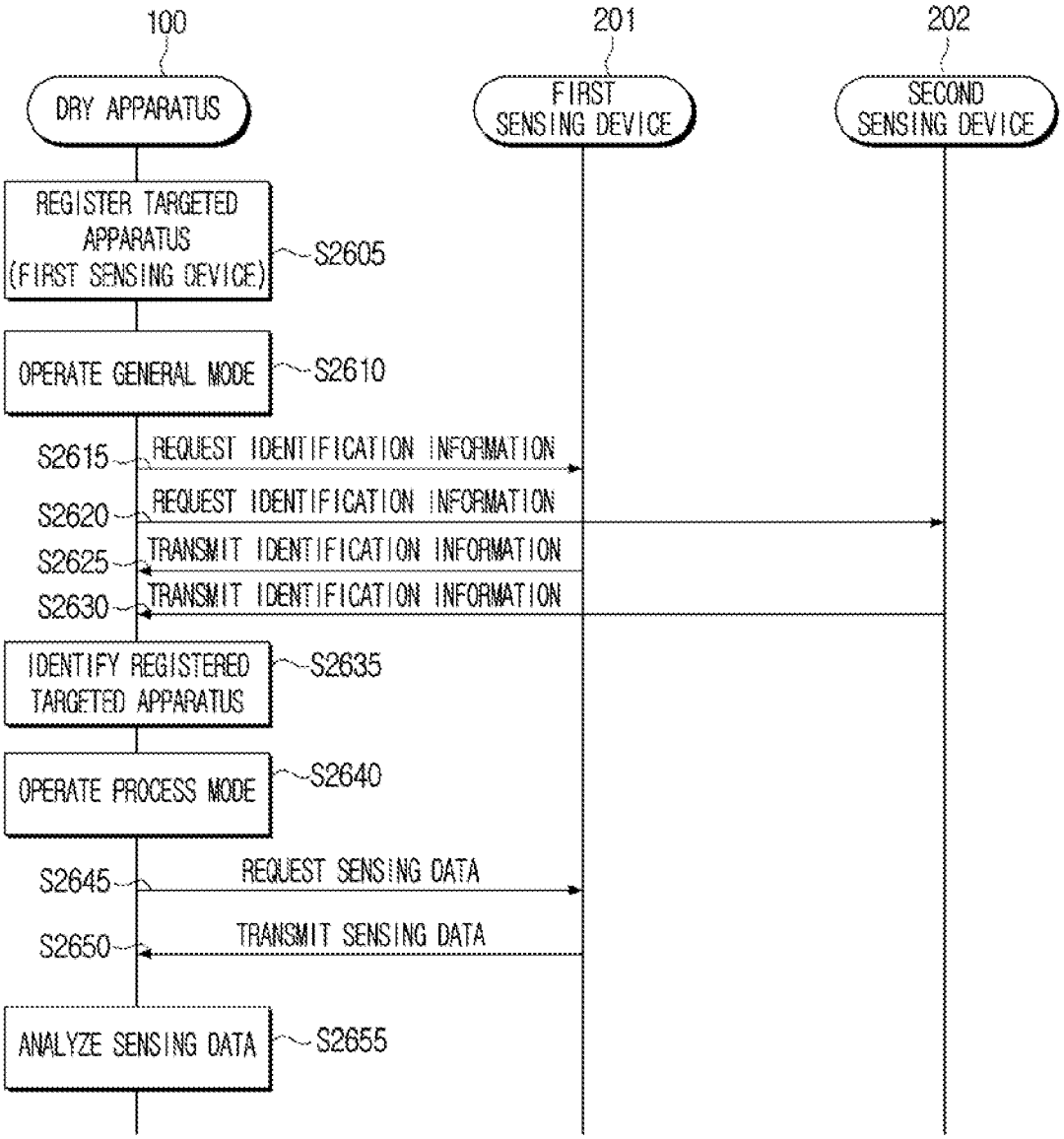
FIG. 26 is a flowchart for describing a normal mode according to another embodiment.

FIG. 26 is a flowchart for describing a normal mode according to another embodiment.

Referring to FIG. 26, it is assumed that the first sensing device 201 is a targeted apparatus of the dry apparatus 100. The dry apparatus 100 may register the first sensing device 201 as a targeted apparatus in operation S2605. The dry apparatus 100 may operate in a normal mode in operation S2610.

The dry apparatus 100 may request identification information from the first sensing device 201 capable of communication connection in operation S2615. In addition, the dry apparatus 100 may request identification information from the second sensing device 202 capable of communicating with communication in operation S2620. Here, the first sensing device 201 may transmit identification information to the dry apparatus 100 in operation S2625. The second sensing device 202 may transmit the identification information to the dry apparatus 100 in operation S2630.

Here, the dry apparatus 100 may identify a registered targeted apparatus based on identification information received from each of the first sensing device 201 and the second sensing device 202 in operation S2635. The dry apparatus 100 may have already stored the identification information of the first sensing device 201 since the first sensing device 201 is registered as the targeted apparatus in operation S2605. Therefore, it is possible to identify which device is a targeted apparatus by comparing the identification information received through the operation S2620 and the operation S2630 and the identification information registered in operation S2630.

The dry apparatus 100 may operate in a process mode based on a user input in operation S2640. In addition, in operation S2645, the dry apparatus 100 may transmit a signal requesting the sensing data to the first sensing device 201 which is a targeted apparatus identified in operation S2635. The first sensing device 201 may transmit sensing data to the dry apparatus 100 in operation S2650.

The dry apparatus 100 may analyze the sensing data received from the first sensing device 201 in operation S2655. In addition, the dry apparatus 100 may determine a detailed setting of the drying cycle or change a predetermined detailed setting based on the analyzed result.

Figure 27:
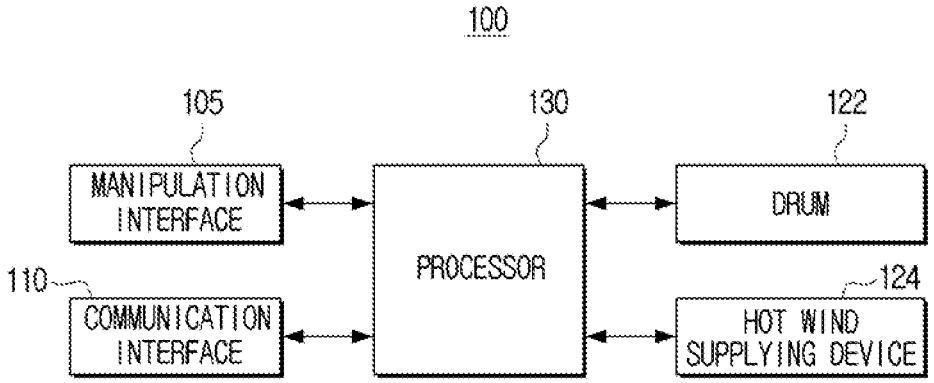
FIG. 27 is a block diagram illustrating a dry apparatus according to another embodiment.

FIG. 27 is a block diagram illustrating a dry apparatus according to another embodiment.

Referring to FIG. 27, the dry apparatus 100 may include the manipulation interface 105, the communication interface 110, the drum 122, the hot wind supplying device 124, and the processor 130.

A detailed description related to the manipulation interface 105, the communication interface 110, the drum 122, the hot wind supplying device 124, and the processor 130 has been described in FIGS. 3 and 4, and a duplicate description will be omitted.

The processor 130 may control the operation of the hot wind supplying device 124 based on the drying course received through the manipulation interface 105, and the processor 130 may determine the operation time of the hot wind supplying device 124 based on the sensing data.

Here, the sensing data may be data acquired from the sensing device 200. The sensing device 200 may transmit sensing data corresponding to the self-generated voltage to the dry apparatus 100. The dry apparatus 100 may receive sensing data of the sensing device 200 through the communication interface 110. Here, the self-generation of the sensing device 200 may be a rotational movement or a drop-off movement by the drum 122 of the dry apparatus 100.

In the meantime, the sensing data may include at least one of humidity or temperature.

Meanwhile, the sensing device 200 may move with the subject to be dried accommodated in the drum 122 by the rotation of the drum 122, and may be connected to the communication interface 110 through wireless communication. The sensing device 200 may transmit sensing data to the dry apparatus 100 by using a wireless communication method. In addition, the dry apparatus 100 may also transmit information to the sensing device 200 by using a wireless communication method.

In the meantime, the processor 130 may acquire a variation width of the voltage through the sensing data, and may determine an operation time based on the fluctuation width of the acquired voltage.

Sensing data may include a voltage corresponding to a self-generation of the sensing device 200. Humidity or temperature may be determined based on the voltage value. For this, a lookup table in which a voltage, humidity, or temperature is matched may be stored in the dry apparatus 100 or the sensing device 200.

Meanwhile, the processor 130 may control a rotating operation of the drum 122, and determine an operation time based on sensing data acquired during a specific time from the time point when the drum 122 was controlled to rotate.

For example, if the processor 130 receives a dry course and a command for starting dry through the manipulation interface 105, the processor 130 may start a dry operation. Here, the processor 130 may determine the operation time of the hot wind supplying device 124 based on sensing data received from the sensing device 200 during a predetermined time from the time point when the dry operation was started to be performed. As an example, the sensing device 200 may regularly transmit the sensing data to the dry apparatus 100, and the dry apparatus 100 may determine the operation time of the hot wind supplying device 124 based on the sensing data received from the sensing device 200 during the predetermined time from the time point when the dry operation was started to be performed. As another example, the sensing device 200 may acquire sensing data only as much as a specific time from the time point when the dry operation was started to be performed.

Here, when the dry operation starts, the processor 130 may transmit a control signal requesting sensing data to the sensing device 200. Depending on implementation examples, the processor 130 may include information on the acquisition time of the sensing data in the control signal requesting the sensing data, and transmit the signal to the sensing device 200. For example, the processor 130 may transmit a control signal requesting to send the sensing data as much as five minutes to the sensing device 200.

Meanwhile, the processor 130 may determine the operation time of the hot wind supplying device 124 as a first time based on the dry course, and determine the operation time of the hot wind supplying device 124 as a second time based on the sensing data, and the second time may be greater than the first time.

For example, if a command for performing a general dry course is received through the manipulation interface 105, the processor 130 may acquire the first time (e.g., one hour) corresponding to the general dry course, and generate a control command to perform a dry operation as much as the first time. The processor 130 may control the hot wind supplying device 124 to operate as much as the first time. Here, the processor 130 may determine the operation time of the hot wind supplying device 124 again based on the sensing data. The time determined again based on the sensing data may be the second time. Then, the processor 130 may control the hot wind supplying device 124 to operate as much as the second time but not the first time. Here, even though the user instructed the general dry course, in actuality, a situation wherein a longer dry time is needed may occur depending on a subject to be dried. Accordingly, the processor 130 may newly determine the operation time of the hot wind supplying device 124 based on the sensing data transmitted by the sensing device 200, and control the hot wind supplying device 124 to operate as much as the newly determined second time. Here, the second time may be a bigger value than the first time.

Meanwhile, while the processor 130 controls the operation of the hot wind supplying device 124 according to the operation time, the processor 130 may change the operation time based on the humidity or the temperature.

Here, the processor 130 may control the hot wind supplying device 124 based on the first time which is a dry time corresponding to the dry course received from the user. Here, the processor 130 may acquire sensing data from the sensing device 200 while operating the hot wind supplying device 124. Then, the processor 130 may acquire a temperature or humidity based on the acquired sensing data.

As an example, the sensing device 200 may acquire a temperature or humidity based on the sensing data corresponding to a voltage according to self-power generation, and transmit the acquired temperature or the acquired humidity to the dry apparatus 100.

As another example, the sensing device 200 may transmit sensing data corresponding to a voltage according to self-power generation to the dry apparatus 100, and the dry apparatus 100 may acquire a temperature or humidity based on the acquired sensing data.

Here, the processor 130 may newly determine the dry time based on the acquired temperature or humidity. The newly determined dry time may be the second time.

Here, the processor 130 may compare the first time and the second time, and determine whether to change the dry time. If the second time is bigger than the first time, the processor 130 may change the dry time such that the hot wind supplying device 124 operates as much as the second time.

Meanwhile, the processor 130 may receive a signal corresponding to the dry degree of the subject to be dried from the dry degree sensor of the sensing device 200 contacting the subject to be dried accommodated in the drum 122, and the sensing data may include humidity data, and the processor 130 may determine whether to operate the hot wind supplying device 124 based on the humidity data acquired after the time point that was determined based on the signal transmitted from the dry degree sensor.

The sensing device 200 may include a dry degree sensor. The dry degree sensor may be arranged on the outer surface of the sensing device 200. Also, the dry degree sensor may physically contact a subject to be dried. The sensing device 200 may receive a signal corresponding to the dry degree through the dry degree sensor. Then, the sensing device 200 may include the signal corresponding to the dry degree in the sensing data, and transmit the data to the dry apparatus 100.

Here, the signal corresponding to the dry degree may be a surface voltage value. The sensing device 200 or the dry apparatus 100 may acquire humidity data based on the surface voltage value.

Here, the sensing device 200 may acquire humidity data based on the signal corresponding to the dry degree. Then, the sensing device 200 may transmit the acquired humidity data to the dry apparatus 100. Meanwhile, depending on implementation examples, the sensing device 200 may transmit a signal corresponding to the dry degree to the dry apparatus 100, and the dry apparatus 100 may acquire humidity data based on the signal corresponding to the dry degree.

Here, while the sensing device 200 already performs an operation of controlling the hot wind supplying device 124 as the first time corresponding to the dry course, the sensing device 200 may determine a new dry time based on humidity data. Here, the new dry time may be the second time. The processor 130 may determine the second time based on humidity data acquired after a predetermined time from the time point when the dry process started. For example, the processor 130 may acquire humidity data five minutes after the dry process started, and determine the second time which is a new dry time based on the acquired humidity data.

Meanwhile, the hot wind supplying device 124 may include a heat pump device that heats air by using condensed heat of a refrigerant and a blowing device, and the processor 130 may control the operation of the heat pump device based on the operation time.

Here, the processor 130 may control the operation of the heat pump device included in the hot wind supplying device 124 for operating the hot wind supplying device 124.

Meanwhile, the sensing device 200 may be a movable sensing device that exists separately from the dry apparatus 100. The sensing device 200 may include an energy harvester that is charged according to the movement of the sensing device 200. Here, the energy harvester may be a device that performs a function of converting potential energy into electronic energy based on the movement of the sensing device 200. Specifically, the energy harvester may acquire a first voltage (or a harvester voltage or a harvesting voltage) according to the movement of the sensing device 200. Then, the sensing device 200 may transmit the acquired first voltage to the dry apparatus 100. The dry apparatus 100 may rotate the drum 122 while performing the dry process. When the drum 122 rotates, the sensing device 200 that exists inside the drum 122 may rotate together, and the sensing device 200 may move up and down by a centrifugal force, etc. The energy harvester included in the sensing device 200 may acquire electronic energy based on potential and kinetic energy. Here, the electronic energy may be expressed as the first voltage.

The processor 130 may acquire a dry time corresponding to the acquired first voltage. Here, a lookup table related to the dry time according to the first voltage having various values may be stored in the memory 150 of the dry apparatus 100. The processor 130 may acquire the dry time corresponding to the first voltage based on the lookup table of the dry time according to the first voltage stored in the memory 150. Then, the processor 130 may perform the dry process as much as the dry time corresponding to the first voltage.

According to one or more embodiments, the processor 130 may control the dry apparatus 100 such that the total dry process is performed as much as the dry time corresponding to the first voltage.

According to another embodiment, the processor 130 may additionally set the dry time corresponding to the first voltage to the dry time that is currently set as the dry process is performed. The dry time of the subject to be dried may have already been determined as the dry process was performed, and the dry time corresponding to the first voltage may be used in determining whether to grant an additional time.

The processor 130 may acquire the first voltage from the sensing device 200, and acquire (or identify) characteristic information of the subject to be dried based on the acquired first voltage. Specifically, the processor 130 may acquire movement amount information including the moving distance or the moving pattern of the sensing device 200 based on the first voltage, and acquire the characteristic information of the subject to be dried based on the acquired movement amount information.

Here, the first voltage value may be a charging voltage value or a harvester voltage value measured at the energy harvester.

Also, the processor 130 may receive sensing data from the sensing device 200. Here, the sensing device 200 may be located inside the drum 122 of the dry apparatus 100. Here, while the dry process is performed, the drum 122 may rotate, and the sensing device 200 may rotate according to the rotation of the drum 122.

According to another embodiment, the sensing device 200 may include a distance sensor that can measure a movement amount according to a rotation. The distance sensor may acquire a moving distance and a moving coordinate of the sensing device 200. Accordingly, the sensing device 200 may identify how much the sensing device 200 moves, i.e., from which height to which height the sensing device 200 falls through the distance sensor. For example, if it is assumed that the sensing device 200 rotates in a state wherein the diameter of the inside of the drum 122 is 70 cm, the sensing device 200 may fall as much as a distance of between 50 cm and 70 cm whenever the drum 122 rotates. Here, the sensing device 200 may acquire movement amount information, and transmit the acquired movement amount information to the dry apparatus 100 through the communication interface of the sensing device 200. Here, the communication interface of the sensing device 200 may include a wireless communication module. The processor 130 may acquire the movement amount information from the sensing device 200. Then, the processor 130 may acquire characteristic information of the subject to be dried based on the acquired movement amount information.

Also, the dry apparatus 100 may acquire at least one of the load (or the weight), the temperature, or the humidity of the subject to be dried. Here, the dry apparatus 100 may include at least one of a sensor that can measure a load, a temperature sensor, or a humidity sensor. Depending on implementation examples, the dry apparatus 100 may include a camera, and may photograph the subject to be dried inside the drum 122 and acquire the image as image data.

The sensing device 200 may acquire at least one of the movement amount, the first voltage (or the charging voltage or the harvester voltage), the moving pattern, the dry degree, the temperature, or the humidity of the sensing device 200. Here, the sensing device 200 may include at least one of a distance sensor that can measure the movement amount of the sensing device, a harvester voltage measurement sensor according to a movement, a moving pattern analysis module, a contact-type electrode sensor that can measure a dry degree, a temperature sensor, or a humidity sensor.

Meanwhile, the processor 130 may determine a dry time corresponding to the acquired sensing data based on the characteristic information of the subject to be dried, and the characteristic information of the subject to be dried may include at least one of the type information of the subject to be dried, the volume information of the subject to be dried, the material information of the subject to be dried, the shape information of the subject to be dried, or the weight information of the subject to be dried.

Here, the dry apparatus 100 may store a lookup table including the dry time corresponding to the sensing data in the memory 150. Then, the processor 130 may operate the hot wind supplying device 124 to perform a dry process as much as the dry time corresponding to the acquired sensing data.

Here, the processor 130 may determine the dry time corresponding to the sensing data by additionally considering the characteristic information of the subject to be dried. Accordingly, even if the sensing data is the same, the dry time may be different according to the characteristic information of the subject to be dried. For example, even if the sensing value acquired from the sensing device 200 is the same, in case the subject to be dried is clothing (characteristic information), the processor 130 may acquire a dry time of one hour, and in case the subject to be dried is bedding (characteristic information), the processor 130 may acquire a dry time of two hours.

Here, the processor 130 may acquire the characteristic information of the subject to be dried based on at least one of the information directly sensed by the dry apparatus 100 or the information directly sensed by the sensing device 200.

As an example, the processor 130 may acquire the characteristic information of the subject to be dried based on the sensing data acquired from the sensing device 200.

As another example, the processor 130 may acquire the characteristic information of the subject to be dried based on the input data directly input by the user.

As still another example, the processor 130 may acquire the characteristic information of the subject to be dried based on the sensing data acquired from a sensor (e.g., a weight sensor or an image sensor) included (installed) in the dry apparatus 100.

As still another example, the processor 130 may acquire the characteristic information of the subject to be dried based on the sensing data acquired from the sensing device 200 and the sensing data acquired from the sensor of the dry apparatus 100 itself.

Here, the processor 130 may acquire sensing data including at least one of the surface dry degree of the subject to be dried, the humidity inside the drum 122, or the temperature inside the drum 122 from the sensing device 200.

The sensing device 200 may acquire a second voltage (or a surface voltage) based on a contact-type electrode sensor, and acquire the humidity information inside the drum 122 or the temperature information inside the drum 122. Then, the sensing device 200 may transmit the acquired surface voltage, humidity information, and temperature information to the dry apparatus 100. The processor 130 may acquire the characteristic information of the subject to be dried based on the sensing data including at least one of the first voltage (or the charging voltage or the harvester voltage), the second voltage (or the surface voltage), the humidity (the humidity inside the dry apparatus), or the temperature (the temperature inside the dry apparatus) received from the sensing device 200.

The type information of the subject to be dried may be information indicating to which category the subject belongs. For example, the type information of the subject to be dried may be clothing, bedding, shirts, or towels. The processor 130 may perform an appropriate dry process based on the type information of the subject to be dried. The type information of the subject to be dried may be classified according to the function of the subject. The processor 130 may determine the type of the subject to be dried based on the movement amount of the sensing device 200. If the movement amount of the subject to be dried is greater than or equal to a first threshold value, the processor 130 may identify that the subject to be dried is clothing.

For example, the volume information of the subject to be dried may mean the total volume of the subject to be dried that exists inside the drum 122. If there is one subject, the volume information may mean one volume, and if there are ten subjects, the volume information may mean ten volumes. The processor 130 may determine the volume of the subject to be dried based on the movement amount of the sensing device 200. The processor 130 may identify the falling distance in the movement amount of the subject to be dried. Then, as the falling distance is bigger, the processor 130 may determine that the volume of the subject to be dried is smaller. Here, the falling distance may mean the distance that the sensing device 200 moved in a vertical direction when the drum 122 rotated once.

The material information of the subject to be dried, and the shape information of the subject to be dried may mean the texture. For example, the material information of the subject to be dried may be cotton, wool, polyester, nylon, silk, denim, leather, cashmere, etc. The material information of the subject to be dried may be classified according to the fabric of the cloth. The processor 130 may determine the material of the subject to be dried based on a moving distance of the sensing device 200 (the moving distance acquired by the first voltage received from the sensing device 200) or the surface voltage acquired from the contact-type electrode sensor. If the frictional force of the material is higher, the moving distance of the sensing device 200 may become shorter, and the surface voltage may be different. Accordingly, the dry apparatus 100 may store a data set according to various materials in advance, and compare the sensed surface voltage value and the data set.

The shape information of the subject to be dried may be information indicating which shape the subject has. For example, the shape information of the subject to be dried may mean a basic shape, a cube shape, a sphere shape, and a cylinder shape. Here, the basic shape may mean a shape that is identified when rotating the drum 122 for drying general clothing, etc. The basic shape may mean a general shape. The processor 130 may determine the shape of the subject to be dried based on the movement amount of the sensing device 200.

The weight information of the subject to be dried may indicate the load of the subject. For example, the weight of the subject to be dried may be a weight in a specific unit such as kg and 10 kg.

Meanwhile, in the aforementioned description, it was described that the processor 130 acquires the characteristic information of the subject to be dried based on the movement amount of the sensing device 200, but the harvester voltage, the moving pattern, the dry degree, the temperature, or the humidity may be additionally considered other than the movement amount of the sensing device 200.

The processor 130 may determine the most appropriate dry method to the subject to be dried by acquiring the characteristic information of the subject to be dried. Specifically, the processor 130 may acquire setting information corresponding to the most appropriate dry process for the subject to be dried. The setting information may include at least one of the dry time, the dry temperature, the strength of hot wind, or the rotating speed of the drum 122. For example, if it is identified that the subject to be dried is silk, the processor 130 may determine the dry time, the dry temperature, and the strength of hot wind appropriate for silk.

Meanwhile, the processor 130 may acquire the moving distance of the sensing device 200 based on the first voltage, and if the acquired moving distance is greater than or equal to the first threshold value, the processor 130 may control the hot wind supplying device 124 to operate as much as the dry time corresponding to clothing, and if the acquired moving distance is smaller than the first threshold value, the processor 130 may control the hot wind supplying device 124 to operate as much as the dry time corresponding to bedding.

Here, as the first voltage value (the charging voltage) is higher, the moving distance may be greater. Accordingly, as the acquired first voltage value of the sensing device 200 is higher, the processor 130 may determine that the moving distance of the sensing device 200 is greater.

As clothing generally does not have a big volume, there may be a lot of empty spaces inside the drum 122. In particular, as moist clothing is in a contracted state, there may be a lot of empty spaces inside the drum 122 while a dry process is being performed. Accordingly, when drying clothing, there may be a lot of spaces wherein the sensing device 200 can move, and the moving distance of the sensing device 200 may be greater.

In contrast, as bedding has a big volume, there may not be a lot of empty spaces inside the drum 122. Accordingly, when drying bedding, there may not be a lot of spaces wherein the sensing device 200 can move, and the moving distance of the sensing device 200 may be smaller.

The processor 130 may acquire the moving distance of the sensing device 200 at a predetermined time point, and if the acquired moving distance is greater than or equal to the first threshold value, the processor 130 may identify that the subject to be dried is clothing. Meanwhile, if the acquired moving distance is smaller than the first threshold value, the processor 130 may identify that the subject to be dried is bedding.

In the aforementioned description or the description below, an operation of identifying clothing or bedding may not be an operation that should necessarily be performed. The processor 130 may determine a dry time based on an acquired moving distance and the first threshold value, without going through an operation of determining (identifying) clothing/bedding.

Depending on implementation examples, the processor 130 may not go through an operation of determining (identifying) clothing/bedding, and if the acquired moving distance is greater than or equal to the first threshold value, the processor 130 may perform a dry process as much as the dry time corresponding to clothing, and if the acquired moving distance is smaller than the first threshold value, the processor 130 may perform a dry process as much as the dry time corresponding to bedding. Here, the operation of performing a dry process may mean rotating the drum 122 or operating the hot wind supplying device 124. Here, the predetermined time point may be the time point when a predetermined time passed after the time point when the dry process started. The predetermined time point or the predetermined time may be changed according to the user's setting. Also, the first threshold value may be changed according to the user's setting. Meanwhile, depending on implementation examples, if the predetermined time point is changed, the first threshold value may also be changed.

Meanwhile, the processor 130 may acquire the moving distance of the sensing device 200 based on the first voltage value, and acquire the second voltage value from the sensing device 200, and acquire the surface dry degree of the subject to be dried based on the second voltage value. Also, if the acquired moving distance is greater than or equal to the first threshold value, the processor 130 may control the hot wind supplying device 124 to operate as much as the dry time corresponding to clothing, and if the acquired moving distance is smaller than the first threshold value and the acquired surface dry degree of the subject to be dried is greater than or equal to the second threshold value, the processor 130 may control the hot wind supplying device 124 to operate as much as the dry time corresponding to bedding, and if the acquired moving distance is smaller than the first threshold value and the acquired surface dry degree of the subject to be dried is smaller than the second threshold value, the processor 130 may control the hot wind supplying device 124 to operate as much as the dry time corresponding to clothing.

Here, the processor 130 may additionally consider the surface dry degree other than the moving distance. The surface dry degree may be determined based on the surface voltage received from the sensing device 200. The sensing device 200 may include a contact-type electrode sensor, and acquire a surface voltage. Here, the surface voltage may mean a voltage sensed at the surface of the sensing device 200, and depending on whether the sensing device 200 contacts the subject to be dried, the sensed surface voltage may be different. In general, if there is moisture in the contacting part, the surface voltage may be sensed to be low.

The processor 130 may analyze the surface voltage received from the sensing device 200 at a predetermined time point, and acquire the surface dry degree. Then, if the surface dry degree is greater than or equal to the second threshold value, the processor 130 may identify that the subject to be dried is bedding, and if the surface dry degree is smaller than the second threshold value, the processor 130 may identify that the subject to be dried is clothing. Bedding has a bigger volume than clothing. Accordingly, the time necessary for drying the entire bedding is greater than the time necessary for drying the entire clothing. However, when considering only the surface, the surface of the bedding may be dried faster. This is because bedding consists of a light cotton material, and while the volume is big, the weight or the density is low. Accordingly, the processor 130 may acquire the surface dry degree at the predetermined time point and compare the surface dry degree with the second threshold value, and if the surface dry degree is greater than or equal to the second threshold value, the processor 130 may identify that the subject to be dried is bedding. Here, the predetermined time point may be changed according to the user's setting. The predetermined time point may be the time point when the predetermined time passed after the dry process started. However, here, the predetermined time point may be 10 minutes to within 30 minutes. This is because the surface dry degree may become close to the maximum value for both of clothing and bedding in case too much time passed. Accordingly, the user may determine in advance the time point when the dry degree of the surface of bedding and the dry degree of the surface of clothing are different, and use the time point as the predetermined time point.

The operation of identifying clothing or identifying bedding based on the moving distance may not be an operation that should necessarily be performed. Depending on implementation examples, the processor 130 may not go through the operation of determining (identifying) clothing/bedding, but determine the dry time based on the acquired moving distance, first threshold value, surface dry degree, and second threshold value.

Meanwhile, the processor 130 may perform additionally dry during a first time for operating as much as the dry time corresponding to clothing, and the processor 130 may perform additional dry during a second time longer than the first time for operating as much as the dry time corresponding to bedding.

Here, the first time may be 0 hour. If the subject to be dried is identified as clothing, the processor 130 may not grant (or allot) a separate additional time. However, if the subject to be dried is identified as bedding, the processor 130 may grant (or allot) an additional time to the dry process for perfect dry.

The processor 130 may identify the type of the subject to be dried at the predetermined time point, and determine whether to grant an additional time. As bedding has a big volume unlike clothing, a longer dry time may be needed. Also, a case wherein dry of the inner surface is not completed even though dry of the outer surface was completed may occur. Accordingly, if the subject to be dried is identified as bedding, the processor 130 may additionally perform the dry process as much as an additional time other than the basic time.

Meanwhile, the processor 130 may acquire the moving pattern information of the sensing device 200 based on the first voltage value, and if it is identified that a specific moving pattern is repeated based on the acquired moving pattern information, the processor 130 may control the hot wind supplying device 124 to operate as much as the dry time corresponding to clothing, and if it is identified that the moving pattern is irregular based on the acquired moving pattern information, the processor 130 may control the hot wind supplying device 124 to operate as much as the dry time corresponding to bedding.

As an example of acquiring the moving pattern information of the sensing device 200 based on the first voltage value, the moving pattern information may be acquired by the sensing device 200, and the processor 130 may acquire the moving pattern information from the sensing device 200.

As another example, the processor 130 may acquire the first voltage from the sensing device 200, and acquire the movement amount information corresponding to the sensing device 200 based on the acquired first voltage. Then, the processor 130 may analyze the acquired movement amount information, and acquire (or analyze) the moving pattern.

The moving pattern may be information indicating in which pattern the sensing device 200 is moving. For example, while general clothing is being dried, the sensing device 200 may rise and descend (or fall) in a vertical direction according to the rotation of the drum 122. Also, as the rotation of the drum 122 occurs repeatedly, the rising and descending pattern may be identified repeatedly. However, while bedding is being dried, the sensing device 200 may irregularly rise and descend in spite of the rotation of the drum 122. This is because, as the volume of the bedding is big, the movement of the sensing device 200 may be restrictive.

Meanwhile, the processor 130 may acquire the second voltage value from the sensing device 200, and while the hot wind supplying device 124 is being controlled, the processor 130 may calculate the number of times that the second voltage value is smaller than the third threshold value during a threshold time based on the current time point, and acquire the surface dry degree information of the subject to be dried based on the calculated number of times.

Here, the processor 130 may acquire the surface voltage value from the sensing device 200, and identify whether the acquired surface voltage value is smaller than the third threshold value. Then, the processor 130 may calculate the number of times that the surface voltage value is smaller than the third threshold value during the threshold time (e.g., 30 seconds) based on the current time point. The feature that the surface voltage value is identified to be low may mean that the humidity is high or there is moisture. Accordingly, the processor 130 may determine the surface dry degree based on the number of times that the surface voltage value is smaller than the third threshold value. As the calculated number of times is more during the threshold time, the processor 130 may identify that the dry degree is lower. Here, the processor 130 may set the standard for the surface dry degree as the third threshold value, and calculate the number of times that the surface voltage value is smaller than the third threshold value during the threshold time.

Meanwhile, if the acquired moving distance is greater than or equal to the first threshold value, the processor 130 may control the hot wind supplying device 124 to operate as much as the dry time corresponding to clothing, and if the acquired moving distance is smaller than the first threshold value and the calculated number of times is greater than or equal to the threshold number of times, the processor 130 may control the hot wind supplying device 124 to operate as much as the dry time corresponding to clothing, and if the acquired moving distance is smaller than the first threshold value and the calculated number of times is smaller than the threshold number of times, the processor 130 may control the hot wind supplying device 124 to operate as much as the dry time corresponding to bedding.

The processor 130 may calculate the number of times that the surface voltage value is smaller than the third threshold value during the threshold time, and classify the type of the subject to be dried depending on whether the calculated number of times is greater than or equal to the threshold number of times. As the calculated number of times is more, it may mean that there is more moist on the surface of the subject to be dried, and the dry degree is low. Accordingly, if the calculated number of times is greater than or equal to the threshold number of times, the processor 130 may determine that the subject to be dried has moisture, and that the subject to be dried is clothing.

The operation of identifying clothing or bedding may not be an operation that should necessarily be performed. The processor 130 may not go through the operation of determining (identifying) clothing/bedding, but determine the dry time based on the calculated number of times and the threshold number of times.

Meanwhile, the processor 130 may control the dry apparatus 100 based on the setting information corresponding to the voltage (the first voltage value), and the setting information corresponding to the voltage (the first voltage value) may include at least one of the dry time, the dry temperature, the strength of the hot wind, or the rotating speed of the drum 122.

Here, the operation of controlling the dry apparatus 100 may mean all control operations necessary for a dry process such as an operation of rotating the drum 122 or an operation of operating the hot wind supplying device 124, etc. for performing a dry process.

The aforementioned threshold value, threshold time, and threshold number of times may be values that were determined by a user in advance. Also, the aforementioned values may vary according to time points. Here, the values of sensing data may vary according to time, and thus the threshold value, the threshold time, and the threshold number of times for analyzing sensing data may also vary according to measurement times.

As an example, sensing data may be measured after a predetermined time point from the time point when the dry process starts (e.g., 30 minutes). This is because, in the case of determining the surface dry degree after about 30 minutes passed, the dry degree may clearly vary according to the type of the subject to be dried. In the case of using only the movement amount of the sensing device 200 but not the surface dry degree, the predetermined time point may be shorter (e.g., 30 seconds).

As another example, sensing data may be measured in case a predetermined event occurred. For example, the predetermined event may be an event wherein the internal humidity (acquired by the dry apparatus 100 by itself) is determined to be smaller than the threshold humidity or an event wherein the dry process is completed.

Meanwhile, the dry apparatus 100 according to one or more embodiments of the disclosure may determine the characteristic information of the subject to be dried based on the movement amount of the sensing device 200. Accordingly, the dry apparatus 100 may automatically perform a dry process appropriate for the subject to be dried even if the user does not directly input the characteristic of the subject to be dried. Accordingly, the dry apparatus 100 can provide high convenience to the user.

Meanwhile, the dry apparatus 100 according to one or more embodiments of the disclosure may acquire the surface dry degree of the subject to be dried by using the surface voltage value. When the surface dry degree is considered other than the movement amount, the material or other characteristics of the subject to be dried may be determined clearly. This is because, even if the dry process is performed for the same time and at the same temperature, the surface dry degree of the subject to be dried is partially different according to the material. Accordingly, the dry apparatus 100 may clearly analyze various subjects to be dried, and provide appropriate dry methods. Accordingly, the dry apparatus 100 may apply an appropriate dry method such that the subject to be dried is not damaged according to a high temperature.

Figure 28:
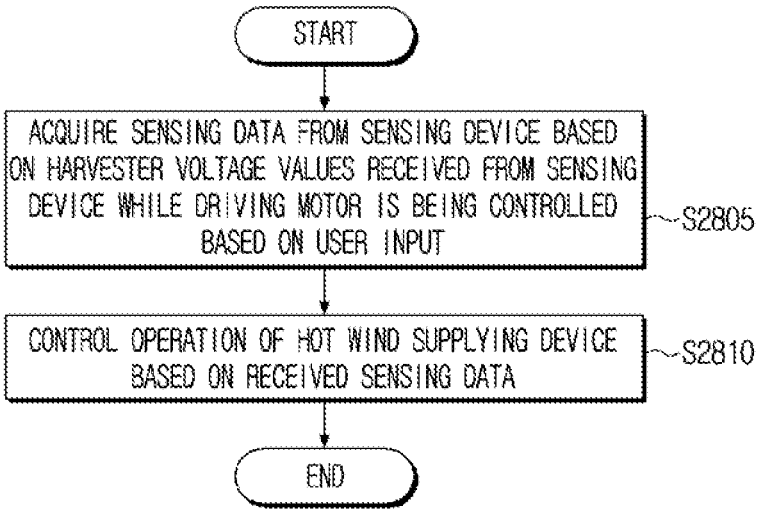
FIG. 28 is a flowchart illustrating a method for controlling a dry apparatus according to an embodiment of the disclosure.

FIG. 28 is a flowchart illustrating a method for controlling a dry apparatus according to an embodiment of the disclosure.

Referring to FIG. 28, the controlling method of the dry apparatus 100 including the drum 122 for receiving a subject to be dried; the driving motor 121 for driving the drum 122; and a hot wind supplying device for supplying hot wind to the drum 122, and communicating with a sensing device self-generating according to rotation of the drum and transmitting a generated harvester voltage value and sensing data includes acquiring sensing data from the sensing device 200 based on a harvester voltage value received from the sensing device 200 while the driving motor 121 is controlled based on a user input in operation S2805; and controlling an operation of the hot wind supplying device 124 based on the received sensing data in operation S2810.

The acquiring the sensing data in operation S2805 may include acquiring the sensing data from the sensing device 200 based on a plurality of harvester voltage values received while the driving motor is being controlled.

The acquiring the sensing data in operation S2805 may include, based on a first harvester voltage value received at a first time point at which the drum rotates being less than a second harvester voltage value received at a second time point at which a predetermined time has elapsed, acquiring the sensing data from the sensing device 200.

The acquiring the sensing data in operation S2805 may include, based on a third harvester voltage value received at a third time point at which the drum stops being equal to or greater than a fourth harvester voltage value received at a fourth time point at which a predetermined time has elapsed, acquiring the sensing data from the sensing device 200.

The method may further include, based on the user input for registering the sensing device 200 corresponding to the dry apparatus 100, controlling the driving motor 121 so that the drum 122 rotates or stops for a predetermined time.

The method may further include acquiring a harvester voltage value from each of a plurality of sensing devices 201, 202 while the driving motor 121 is controlled based on the user input; and identifying at least one sensing device corresponding to the dry apparatus 100 among the plurality of sensing devices 201, 202 based on the acquired harvester voltage value, and the acquiring the sensing data in operation S2805 may include acquiring the sensing data from at least one identified sensing device.

The method may further include, based on the at least one sensing device not being identified, outputting first guide information for guiding the sensing device 200 to be positioned inside the dry apparatus 100.

The method may further include, based on a number of the at least one sensing device exceeding a predetermined number, acquiring the number of control operations for rotating and stopping the driving motor 121; and based on the number of control operations being greater than or equal to a threshold value, outputting second guide information for notifying that the sensing device cannot be specified.

The method may further include, based on the number of the at least one sensing device exceeding a predetermined number, outputting third guide information to a user for checking the number of sensing devices corresponding to the dry apparatus 100.

The method may further include identifying at least one sensing device corresponding to the dry apparatus 100 from among the plurality of sensing devices based on the acquired harvester voltage value change amount and threshold value; and based on the number of the at least one sensing device exceeding a predetermined number, identifying at least one sensing device corresponding to the dry apparatus 100 by changing the threshold value.

The method for controlling the dry apparatus 100 as shown in FIG. 28 may be executed on a dry apparatus 100 having the configuration of FIG. 3 or FIG. 4, and may also be executed on an electronic device having other configurations.

Methods according to the embodiments as described above may be implemented as an application format installable in an existing electronic apparatus.

Methods according to the various example embodiments as described above may be implemented as only software upgrade or hardware upgrade for an existing electronic apparatus.

Various example embodiments described above may be performed through an embedded server provided in an electronic apparatus, or an external server of at least one electronic apparatus and a display device.

Various example embodiments may be implemented in software, including instructions stored on non-transitory machine-readable storage media readable by a machine (e.g., a computer). An apparatus may call instructions from the storage medium, and execute the called instruction, including an electronic apparatus, such as electronic apparatus A. When the instructions are executed by a processor, the processor may perform a function corresponding to the instructions directly or using other components under the control of the processor. The instructions may include a code generated by a compiler or a code executable by an interpreter. A machine-readable storage medium may be provided in the form of a non-transitory storage medium, which is tangible, and does not distinguish the case in which a data is semi-permanently stored in a storage medium from the case in which a data is temporarily stored in a storage medium.

The method according to the above-described embodiments may be included in a computer program product. The computer program product may be traded as a product between a seller and a consumer. The computer program product may be distributed online in the form of machine-readable storage media (e.g., compact disc read only memory (CD-ROM)) or through an application store (e.g., PLAYSTORE™) or distributed online directly. In the case of online distribution, at least a portion of the computer program product may be at least temporarily stored or temporarily generated in a server of the manufacturer, a server of the application store, or a machine-readable storage medium such as memory of a relay server.

The respective elements (e.g., module or program) mentioned above may include a single entity or a plurality of entities. At least one element or operation from of the corresponding elements mentioned above may be omitted, or at least one other element or operation may be added. Alternatively or additionally, some components (e.g., module or program) may be combined to form a single entity. In this case, the integrated entity may perform functions of at least one function of an element of each of the plurality of elements in the same manner as or in a similar manner to that performed by the corresponding element from of the plurality of elements before integration. The module, a program module, or operations executed by other elements according to embodiments may be executed consecutively, in parallel, repeatedly, or heuristically, or at least some operations may be executed according to a different order, may be omitted, or the other operation may be added thereto.

While the disclosure has been illustrated and described with reference to various example embodiments, it will be understood that the various example embodiments are intended to be illustrative, not limiting. It will be further understood by those skilled in the art that various changes in form and detail may be made without departing from the true spirit and full scope of the disclosure, including the appended claims and their equivalents.

What is claimed is:

1. A dryer comprising:

a drum configured to receive a subject to be dried;

a driving motor configured to drive the drum;

a hot wind supplying device to supply hot air to the drum;

a communication interface configured to communicate with a sensing device that obtains at least one of a harvester voltage value in association with a movement of an energy harvester in the sensing device as the drum rotates while being driven by the driving motor and sensing data sensed by the sensing device; and a processor configured to:

obtain the sensing data from the sensing device based on the harvester voltage value which is transmitted from the sensing device while the driving motor is being controlled based on an input of a user, and control an operation of the hot wind supplying device based on the obtained sensing data.

2. The dryer of claim 1, wherein the processor is further configured to obtain the sensing data from the sensing device based on a plurality of harvester voltage values received while the driving motor is being controlled.

3. The dryer of claim 2, wherein the harvester voltage value is a first harvester voltage value received at a first time point at which the drum rotates, and the processor is further configured to:

based on the first harvester voltage value received at the first time point at which the drum rotates being less than a second harvester voltage value received at a second time point at which a predetermined time has elapsed, obtain the sensing data from the sensing device.

4. The dryer of claim 2, wherein the processor is further configured to, based on the harvester voltage value being received at a time point at which the drum stops rotating and being equal to or greater than another harvester voltage value received at another time point at which a predetermined time has elapsed, obtain the sensing data from the sensing device.

5. The dryer of claim 1, wherein the processor is further configured to, based on a user input to register the sensing device in association with the dryer, control the driving motor so that the drum rotates or stops for a predetermined time.

6. The dryer of claim 1, wherein the sensing device is among a plurality of sensing devices, and the processor is further configured to:

obtain a respective harvester voltage value from the plurality of sensing devices while the driving motor is being controlled based on the input of the user, determine whether at least one sensing device, among the plurality of sensing devices, is identifiable in association with the dryer based on the obtained respective harvester voltage value, and obtain the sensing data from at least one identified sensing device.

7. The dryer of claim 6, wherein the processor is further configured to, based on the at least one sensing device being unidentified, output guide information providing guidance to position the sensing device inside the dryer.

8. The dryer of claim 6, wherein the processor is further configured to:

based on a number of the at least one sensing device exceeding a predetermined number, obtain a number of control operations to rotate and to stop the driving motor, and based on the number of control operations being greater than or equal to a threshold value, output guide information providing notification that the sensing device cannot be specified.

9. The dryer of claim 6, wherein the processor is further configured to, based on a number of the at least one sensing device exceeding a predetermined number, output guide information to the user to check a number of sensing devices associated with the dryer.

10. The dryer of claim 6, wherein the processor is further configured to:

identify at least one sensing device associated with the dryer from among the plurality of sensing devices based on a change amount of the harvester voltage value and a threshold value, and based on a number of the at least one sensing device exceeding a predetermined number, identify at least one sensing device as being associated with the dryer by changing the threshold value.

11. A method of controlling a dryer including a drum, a driving motor, and a hot wind supplying device, the method comprising:

communicating with a sensing device in the drum, which is configured to receive a subject to be dried, and rotate while being driven by the driving motor;

obtaining at least one of a harvester voltage value in association with the movement of the energy harvester in the sensing device and sensing data sensed by the sensing device, wherein the obtaining of the sensing data includes obtaining the sensing data from the sensing device based on the harvester voltage value transmitted from the sensing device while the driving motor is being controlled based on an input of a user; and controlling an operation of the hot wind supplying device based on the obtained sensing data.

12. The method of claim 11, wherein the obtaining of the sensing data includes obtaining the sensing data from the sensing device based on a plurality of harvester voltage values received while the driving motor is being controlled.

13. The method of claim 12, wherein the harvester voltage value is a first harvester voltage value received at a first time point at which the drum rotates, and the obtaining the sensing data comprises:

based on the first harvester voltage value received at the first time point at which the drum rotates being less than a second harvester voltage value received at a second time point at which a predetermined time has elapsed, obtaining the sensing data from the sensing device.

14. The method of claim 12, wherein the obtaining the sensing data comprises, based on the harvester voltage value being received at a time point at which the drum stops rotating and being equal to or greater than another harvester voltage value received at another time point at which a predetermined time has elapsed, acquiring the sensing data from the sensing device.

15. The method of claim 11, further comprising:

based on a user input being to register the sensing device in association with the dryer, controlling the driving motor so that the drum rotates or stops for a predetermined time.

* * * * *